US006189974B1

(12) United States Patent
Beck

(10) Patent No.: US 6,189,974 B1
(45) **Date of Patent: *Feb. 20, 2001**

(54) CHAIR CONSISTING OF INTERLOCKING ELEMENTS

(76) Inventor: Christian Beck, rue Lugardon 1, cp 1265, 1211 Geneva 1 (CH)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/155,504

(22) PCT Filed: Apr. 1, 1997

(86) PCT No.: PCT/IB97/00320

§ 371 Date: Sep. 28, 1998

§ 102(e) Date: Sep. 28, 1998

(87) PCT Pub. No.: WO97/36520

PCT Pub. Date: Oct. 9, 1997

(30) Foreign Application Priority Data

| | | |
|---|---|---|
| Mar. 29, 1996 | (CH) | 0824/96 |
| Jun. 18, 1996 | (CH) | 1521/96 |
| Jul. 31, 1996 | (CH) | 1915/96 |

(51) Int. Cl.[7] ..... A47C 4/02

(52) U.S. Cl. ..... 297/440.13; 297/440.15

(58) Field of Search ..... 297/440.1, 440.13, 297/440.15, 440.2

(56) References Cited

U.S. PATENT DOCUMENTS

| | | | | |
|---|---|---|---|---|
| 2,534,413 | * | 12/1950 | Cenis | 297/440.13 |
| 3,547,491 | * | 12/1970 | Bovasso | 297/440.13 |
| 4,225,180 | * | 9/1980 | Gillis | 297/440.13 |
| 4,593,950 | * | 6/1986 | Infanti | 297/440.13 X |
| 4,712,837 | * | 12/1987 | Swilley | 297/440.13 |

FOREIGN PATENT DOCUMENTS

4421338 * 1/1996 (DE) .

* cited by examiner

*Primary Examiner*—Peter R. Brown
(74) *Attorney, Agent, or Firm*—Collard & Roe, P.C.

(57) ABSTRACT

A seat comprising side uprights (110, 110'), a seat (120) and a back (130). It also includes a primary interlocking system (111, 111') to attach the side uprights in a roughly perpendicular fashion to the seat, a second interlocking system (122) to attach the seat in a roughly perpendicular fashion to the back, a wedge system (150) positioned between the back and the side uprights, and fasteners to lock the wedge system to the back and side uprights. Once the seat, uprights and back are interlocked, the whole assembly is held together by assembling the wedge system and fixing it in position using the fasteners.

21 Claims, 24 Drawing Sheets

CHAIR CONSISTING OF INTERLOCKING ELEMENTS

The invention described herein concerns a seat comprising a number of interlocking components including side uprights, a seat piece and a back, a primary interlocking system allowing the side uprights to be fixed to the seat piece in a roughly perpendicular fashion, a second interlocking system allowing the seat piece to be fixed roughly perpendicular to the back.

Seats which can be fitted together and taken apart are commonplace within the relevant prior art. Document US-A-3 547 491, for example, shows a seat comprising several interlocking components which can be fitted together. This seat required no additional means of fixing and can be assembled using the different fixing methods.

Other techniques involve the use of screws and nuts to ensure that the seat is stable once assembled. This makes for more complex assembly and disassembly procedures and, with the large number of component parts used in the assembly, there is a greater risk that some—screws, nuts or plugs, for example—will be mislaid in the process.

Our invention sets out to solve this problem by reducing the number of component parts necessary to hold the seat together when assembled. More particularly, the aim of the invention is to create a seat which, once fully assembled, is held together by a minimum number of fastenings, such as screws and nuts. The assembled seat's stability is, for the most part, ensured by the way in which the different component parts of the seat interlock and by the various fasteners which guarantee correct fitting of these parts.

The annexed drawings represent, by way of example, different configurations of the chair according to the invention.

FIGS. 20*a*–20*j* show a perspective of one way of assembling the seat on configuration three.

Figure 21:
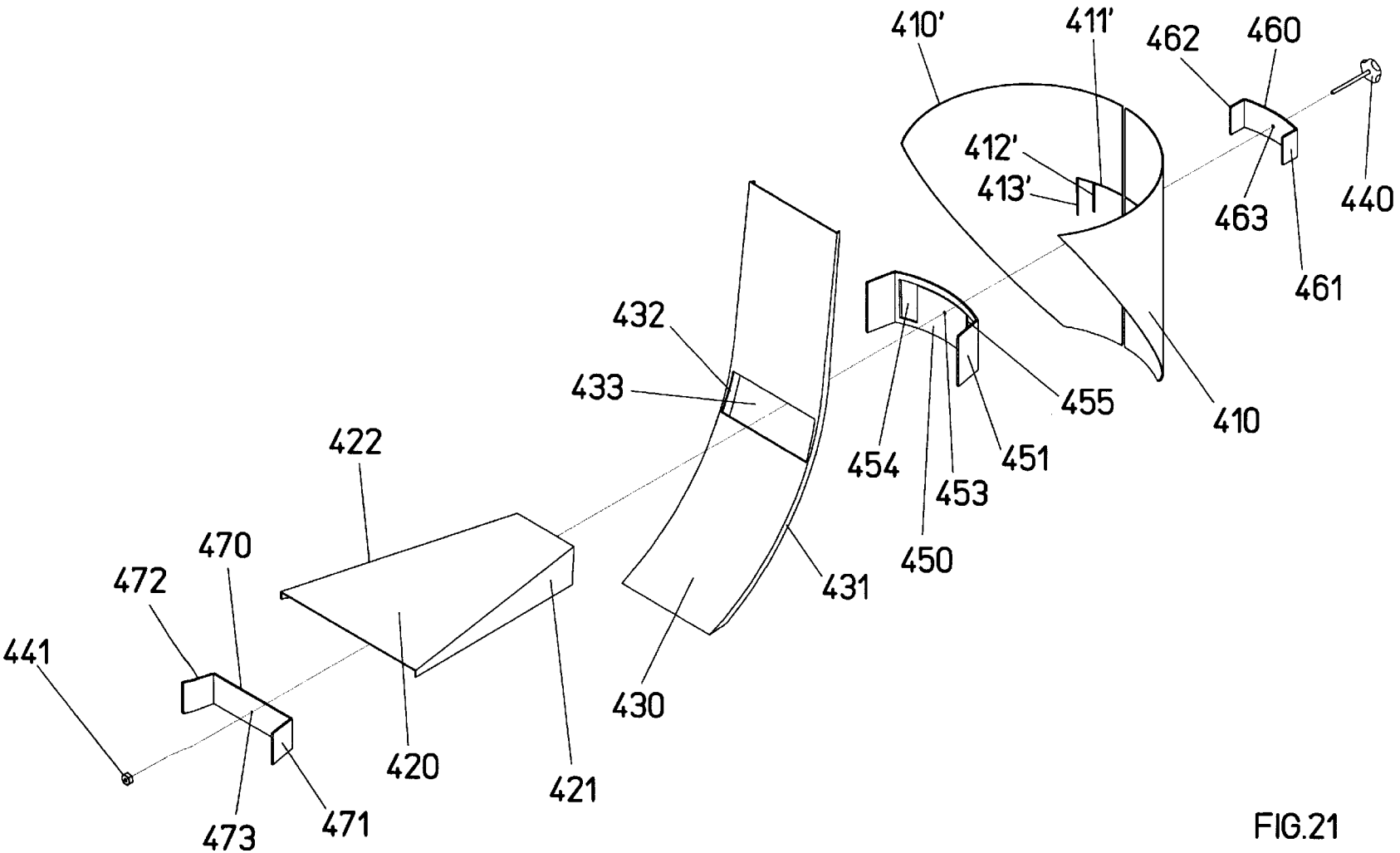

FIG. 21 shows a full perspective of configuration four of the invention.

Figure 22:
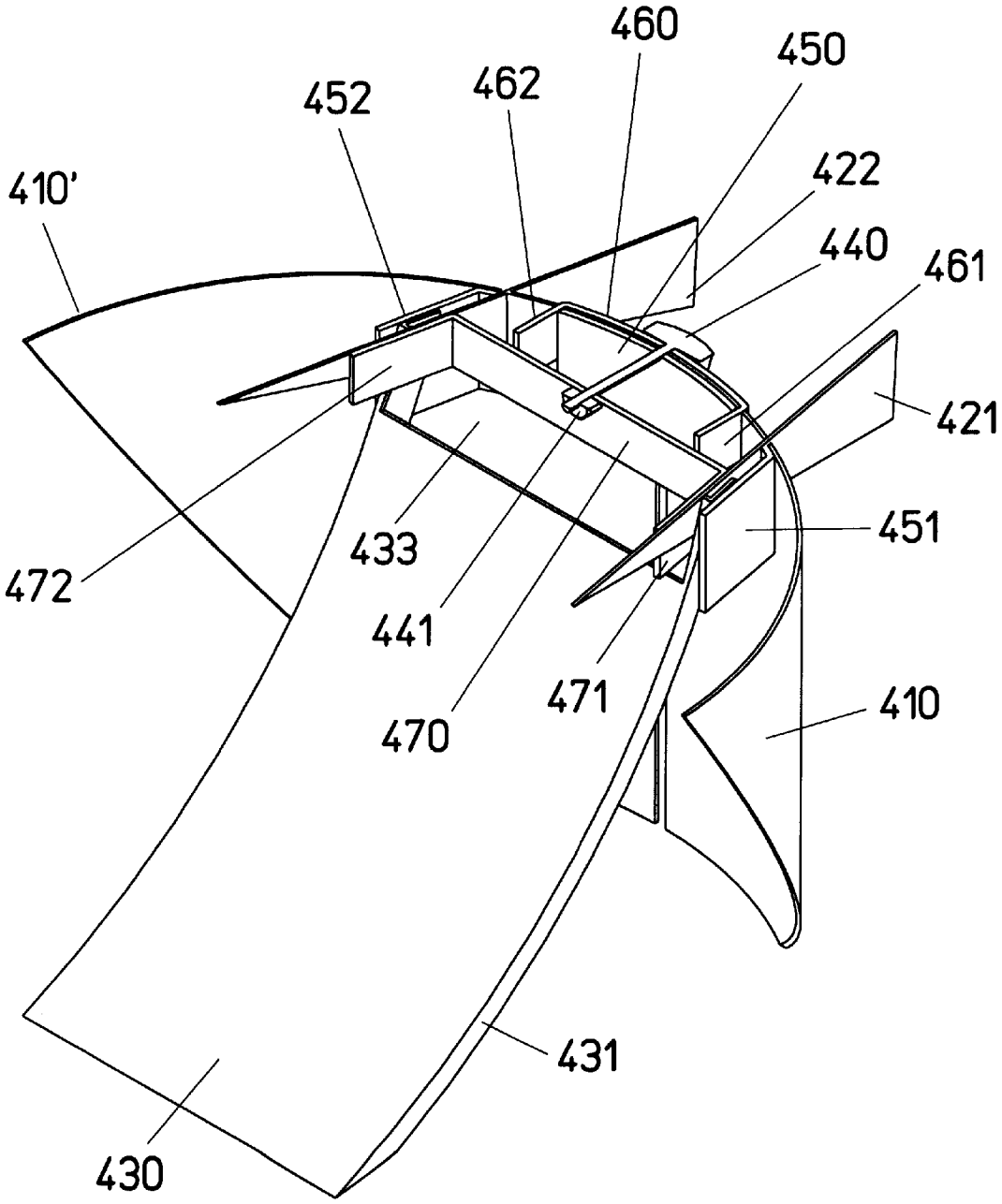

FIG. 22 shows a perspective and a horizontal section of configuration four.

Figure 23:
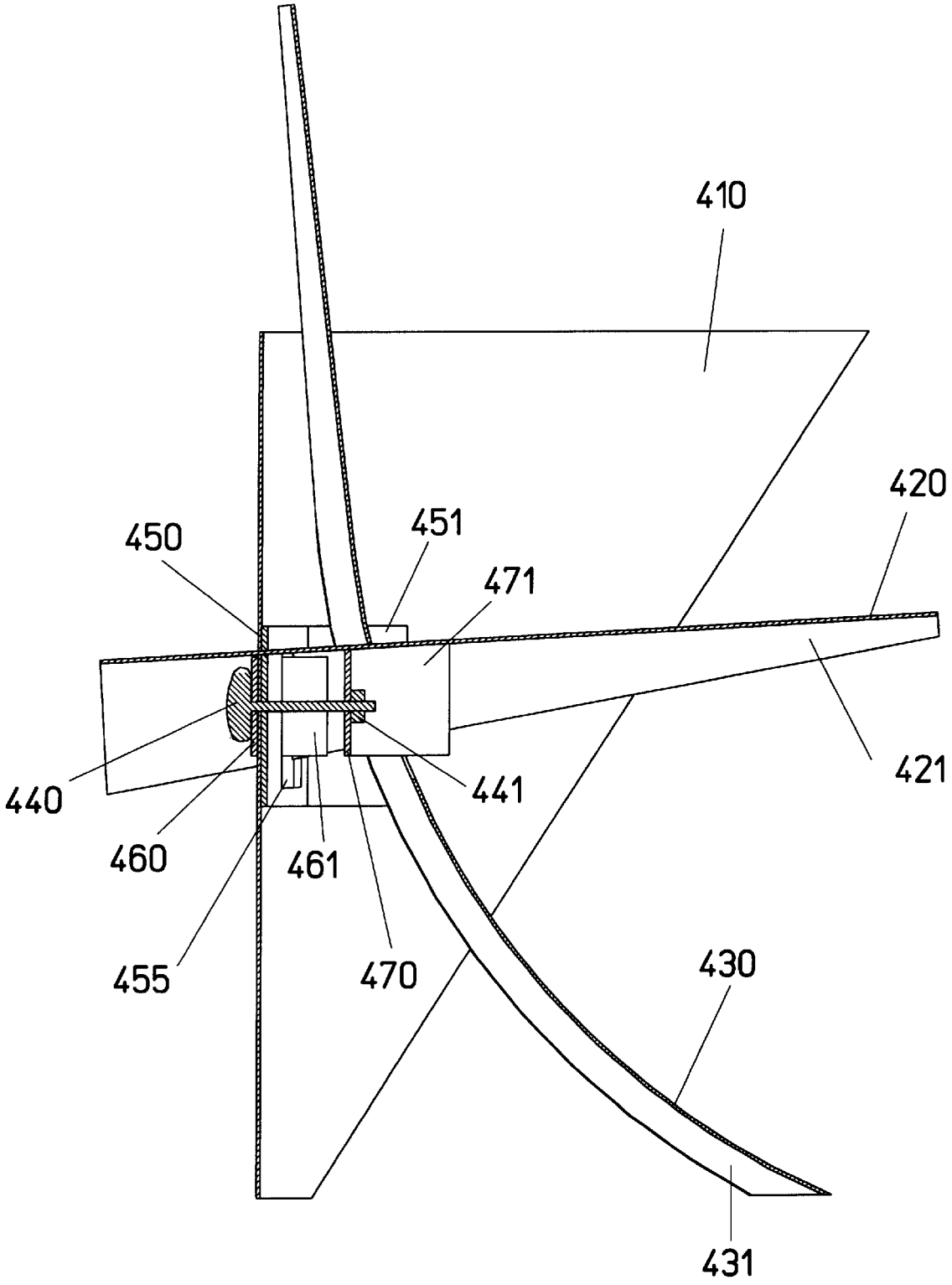

FIG. 23 shows a vertical section of configuration four.

Figure 24:
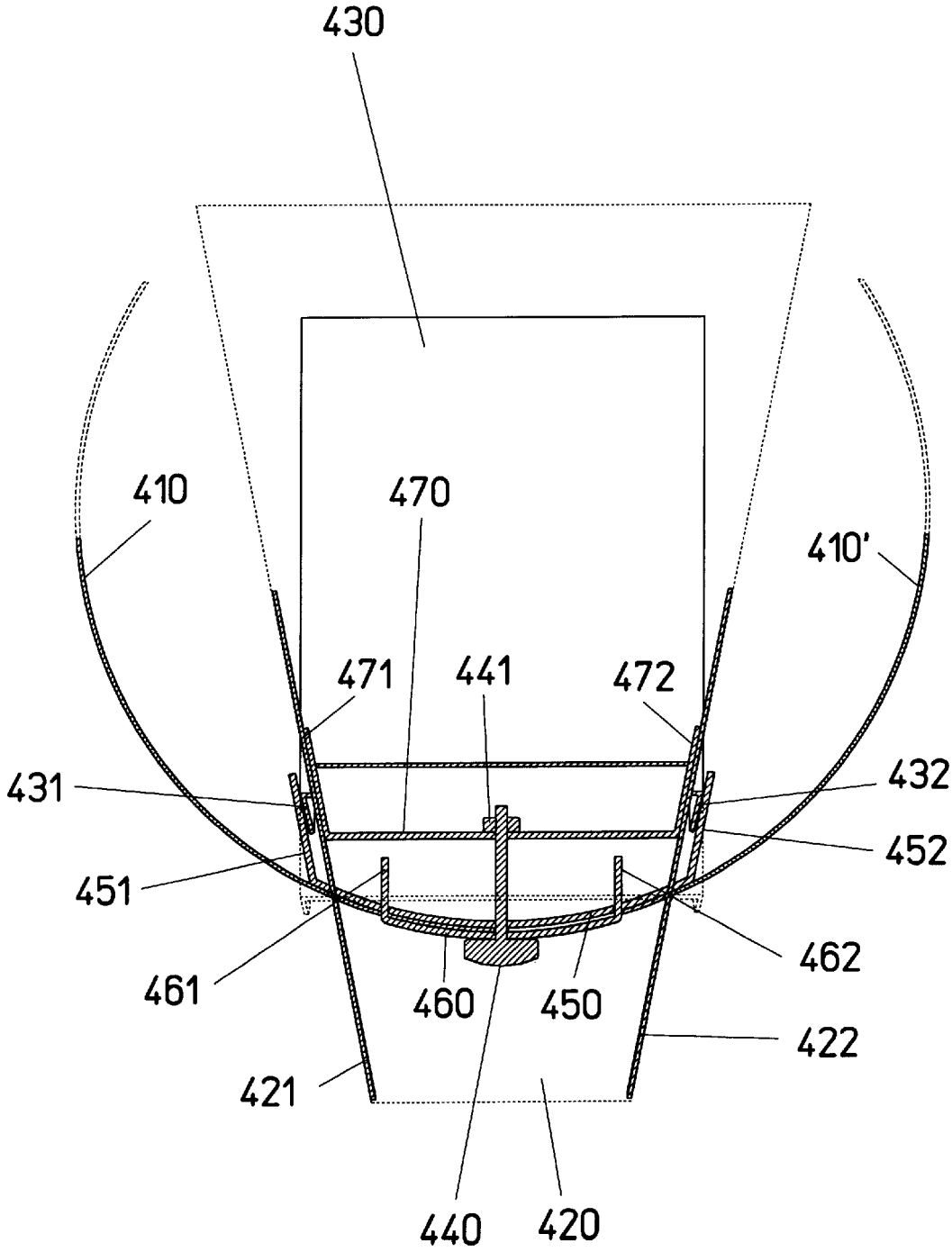

FIG. 24 shows a horizontal section of configuration four.

The first configuration will now be described in detail in reference to FIGS. 1 through 8.

Figure 1:
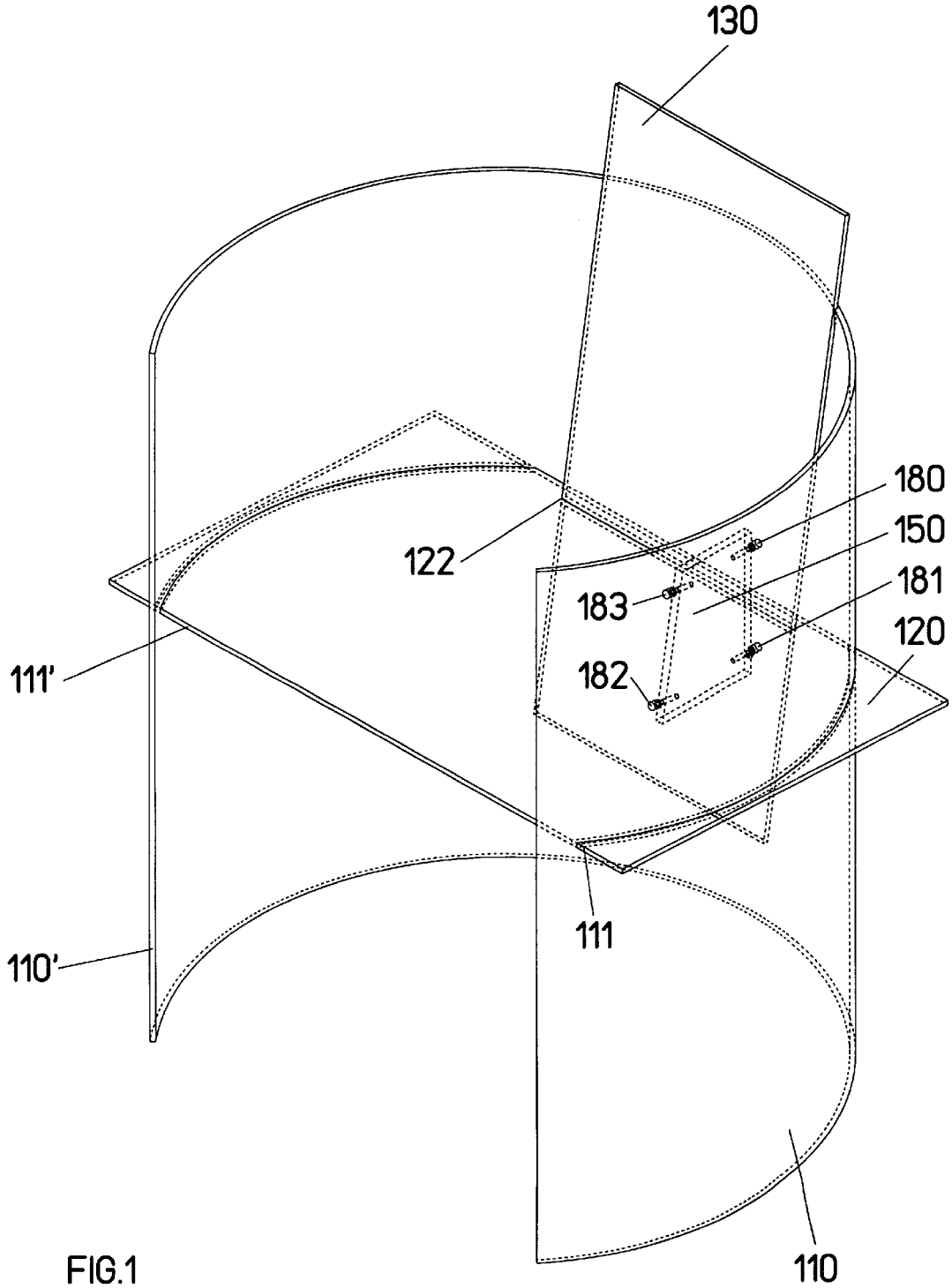
FIG. 1 shows a front perspective of the first configuration.
Figure 2:
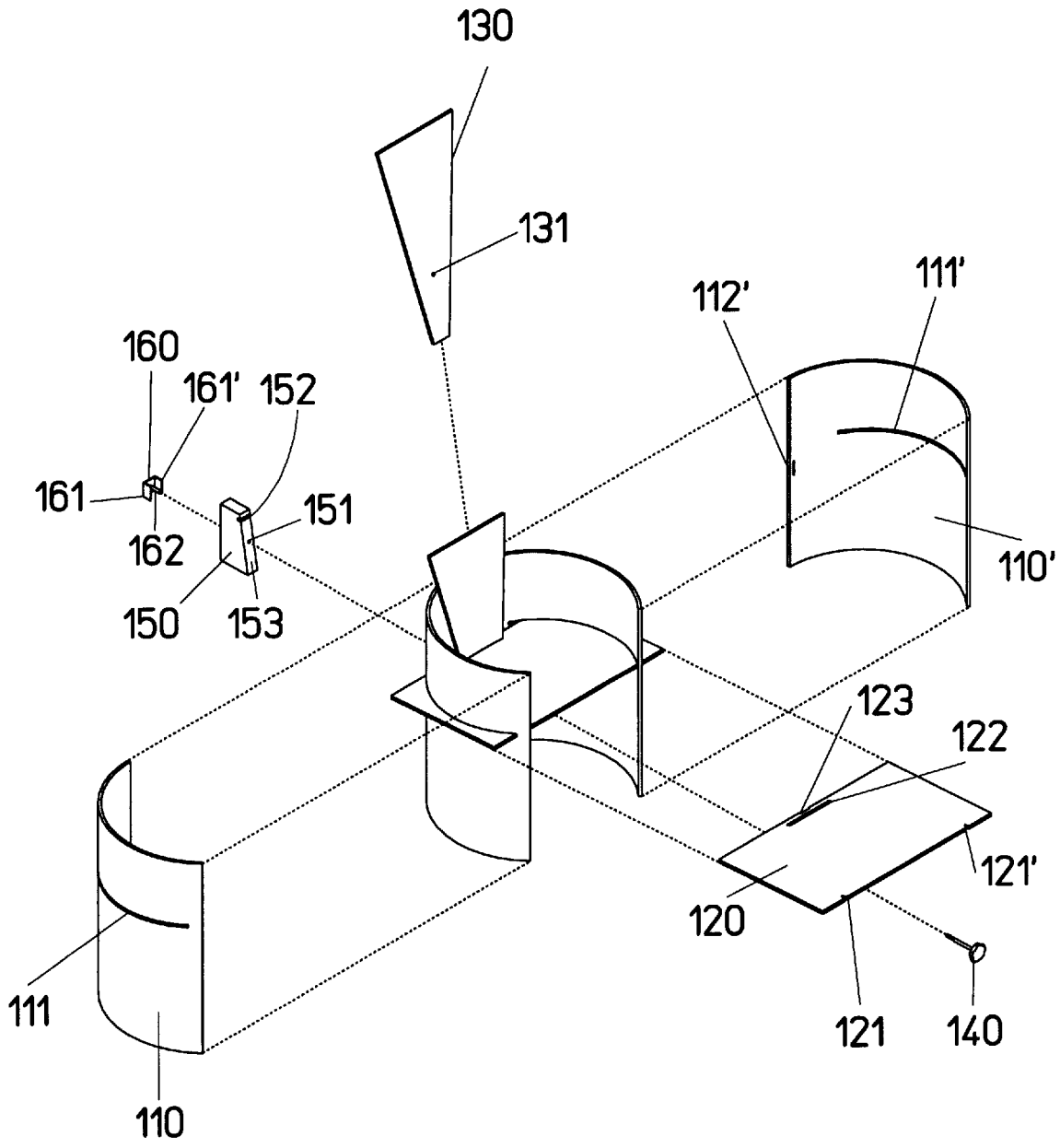
FIG. 2 shows a full perspective of variation one on the first configuration.
Figure 3:
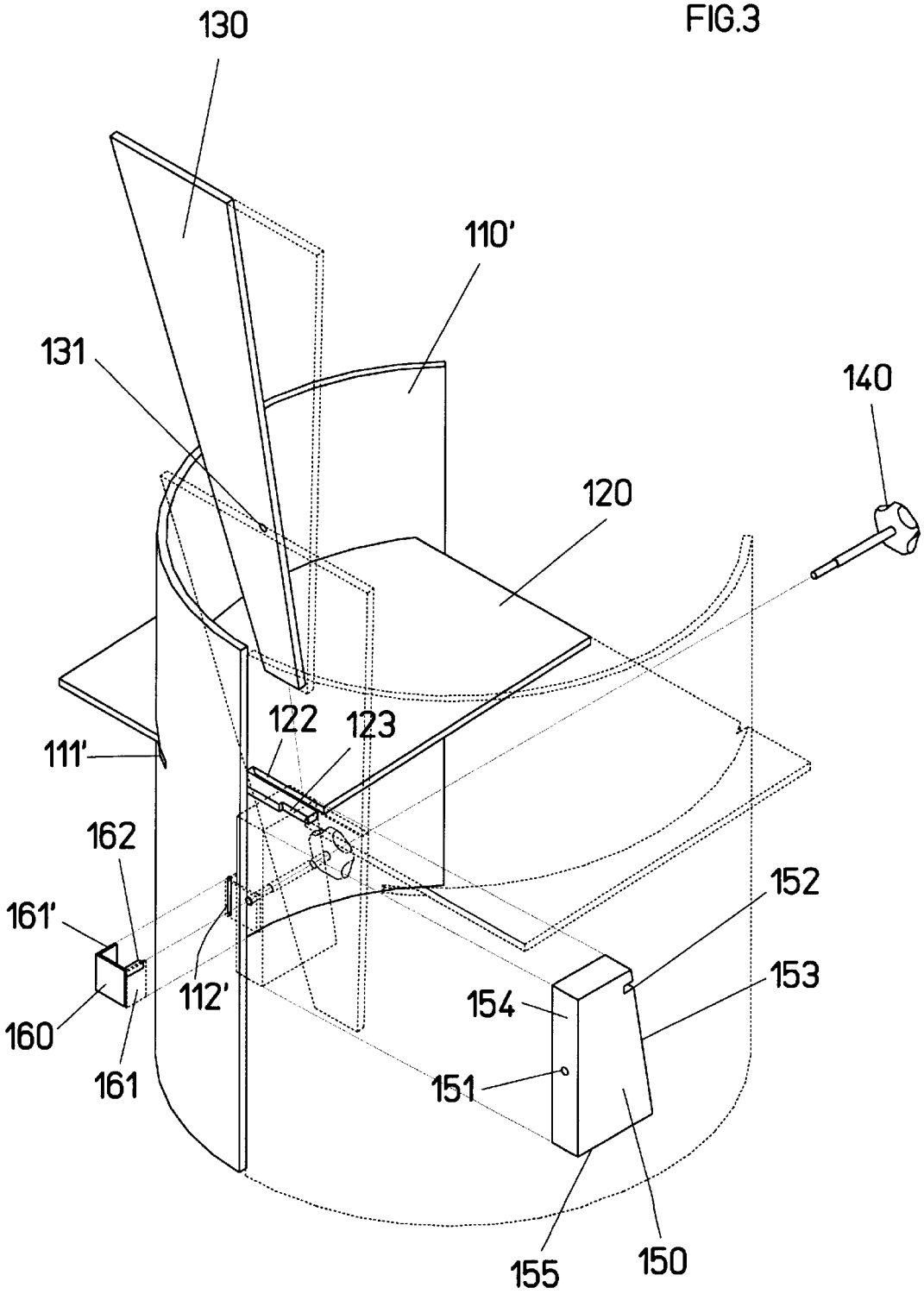
FIG. 3 shows a rear perspective and vertical section of variation one.
Figure 4:
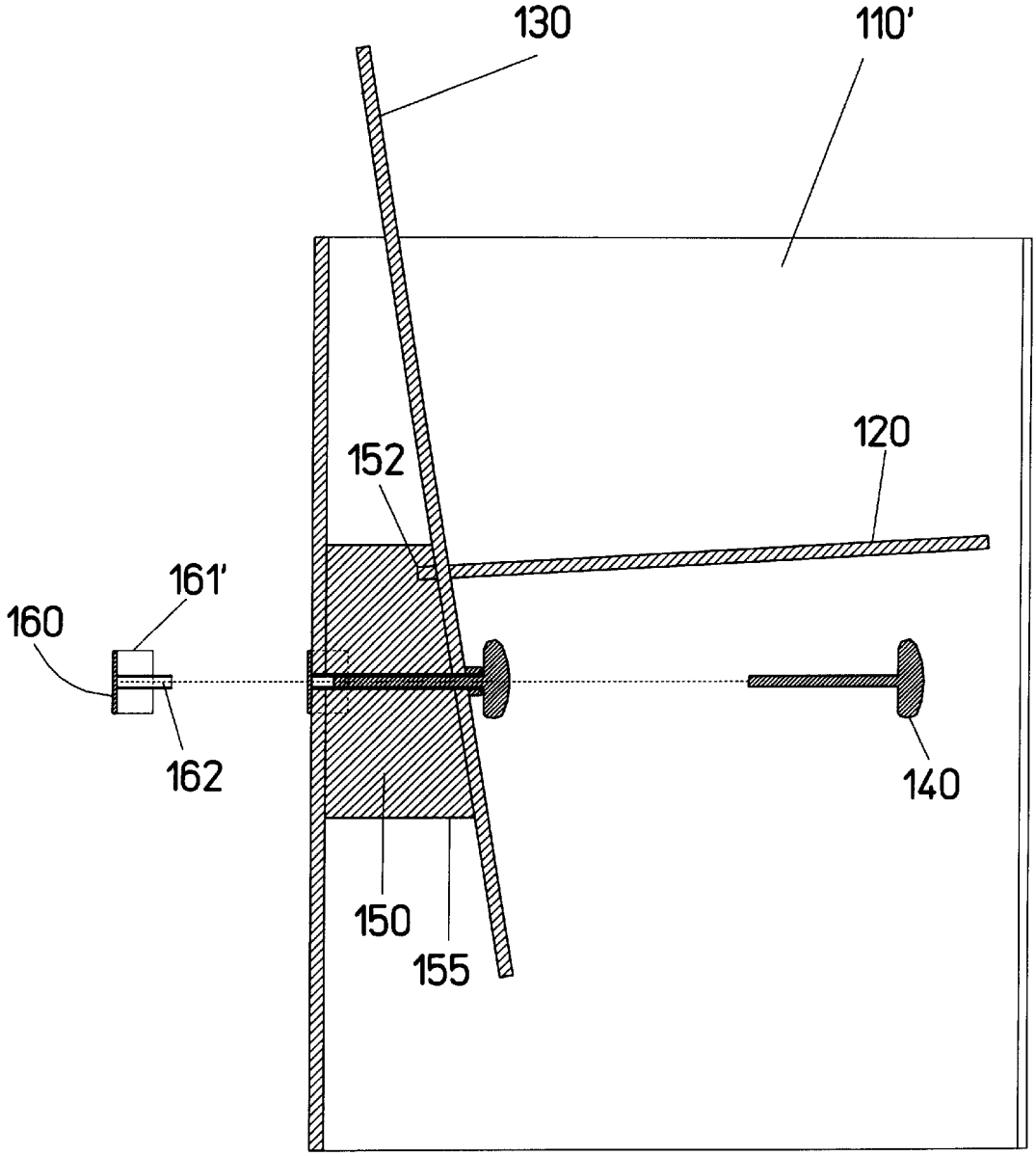
FIG. 4 shows a vertical section of variation one.
Figure 5:
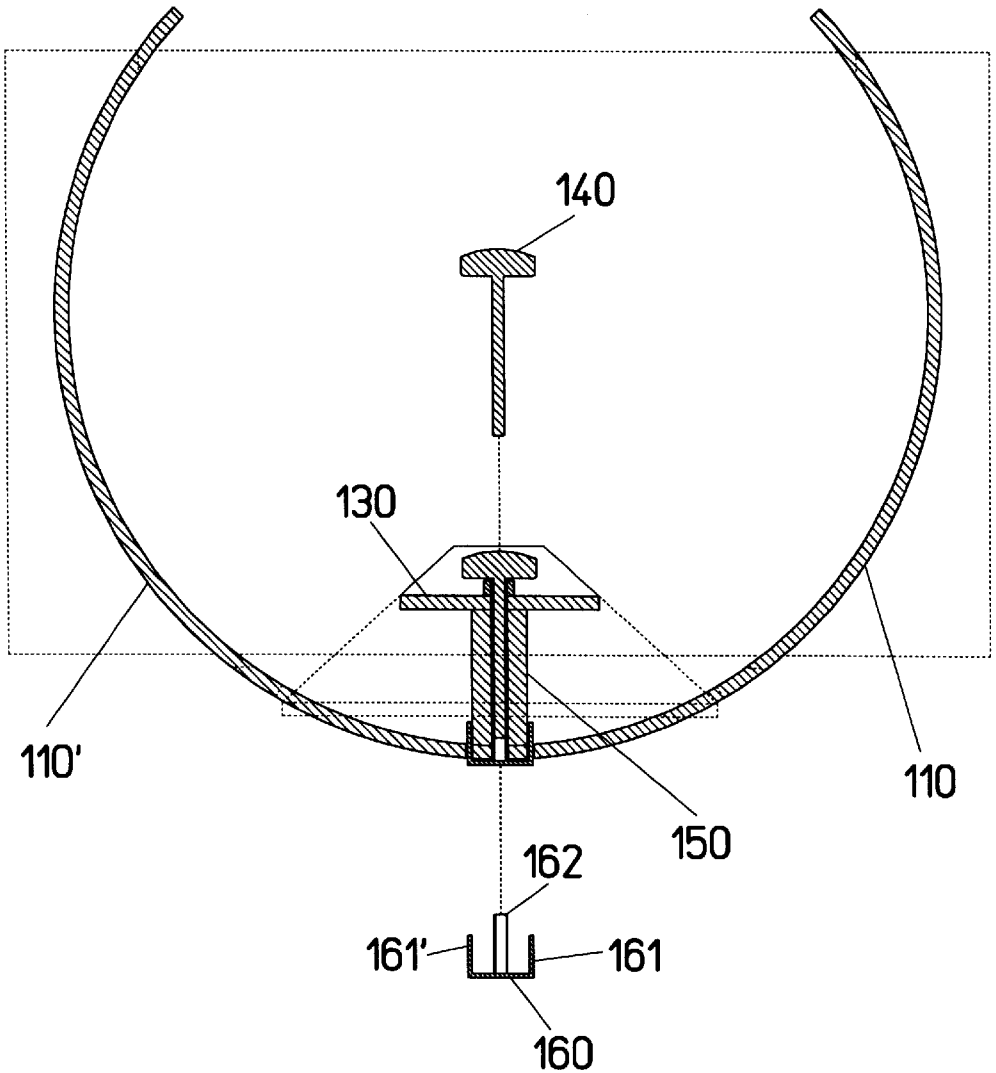
FIG. 5 shows an overhead horizontal section of variation one.

In FIG. 1, the different parts that make up seat configuration one are shown.

The seat comprises uprights 110, 110' forming a single piece, a seat 120, a back 130, and a wedge system 150. Each of the uprights 110 & 110' have a roughly horizontal slot 111 & 111', constituting the first interlocking system and into which slot the side edges of seat 120. Seat 120 has a slot 122 close to its rear edge into which the back slots, roughly perpendicular to the seat, thereby constituting an interlocking system between seat 120 and back 130. To lock back 130 to uprights 110, 110', wedge 150 is inserted between back 130 and uprights 110, 110'. The inclined face of wedge 150 comes into contact with the rear face of back 130. Wedge 150 and back 130 are held together by fastenings, for example using screws 182, 183 or similar. The face opposite the inclined face of wedge 150 comes into contact with uprights 110, 110' and is held in place by fasteners, for example using screws 180, 181 or similar. Back 130 is thus fixed firmly to the uprights 110, 110' and, in this way, the different interlocking elements of the assembled seat are held together.

In this first configuration, the wedge piece may either be placed beneath seat 120, as shown in FIG. 1, or above it and fixed to back 130 and to uprights 110, 110' in the same way as described above.

FIGS. 2 through 6 show a variation on seat configuration one. Components common to the first configuration and this first variation are labeled using the same references. The seat in this variation is basically made up of symmetrical side uprights 110, 110', seat 120, back 130, screw 140, wedge 150 and a rider 160. Uprights 110, 110' are part cylindrical in shape and are joined edge to edge at the rear of the seat. These uprights 110, 110' each have an interlocking system comprising a roughly horizontal slot 111, 111' into which the side edges of seat 120 interlock, perpendicular to the side uprights.

Seat 120 has two notches 121, 121' on its front edge which prevent any lateral movement of seat 120 once it is interlocked with the uprights. By way of a second interlocking system between seat 120 and back 130, seat 120 has a slot 122 close to its rear edge. Back 130 interlocks with this slot so that it is roughly perpendicular to seat 120.

A third interlocking system between seat 120 and wedge 150 has been integrated into the design. This comprises a horizontal groove 152 cut into wedge 150 and into which seat 120 is pushed by means of notch 123 on its rear edge. Back 130 has a hole 131 in its lower half. Hole 131 is designed to accept screw 140 Wedge 150 also has a hole 151 going through it from inclined plane 153 to side 154 opposite the inclined plane parallel to the third side 155. Inclined plane 153 is designed to fit against the rear face of back 130 and side 154, opposite the inclined plane and perpendicular to hole 151, is designed to fit against the inside face of the rear join of uprights 110, 110'. The seat also comprises rider 160 which interlocks by means of its two wings 161, 161' with slots 112, 112' in the side uprights, thus ensuring the upright joins are held fast. Rider 160 is firmly attached to nut 162 positioned between the rider's wings 161, 161'. Once all the various component parts have been interlocked, the overall assembly is locked together using screw 140, which passes through the holes in back 130 and wedge 150, respectively 131, 151, where the uprights meet and is screwed into nut 162 on rider 160. A rider of this type is not absolutely essential, since the nut alone, through the friction on the side uprights 110, 110', is able to hold the join fast.

Figure 6:
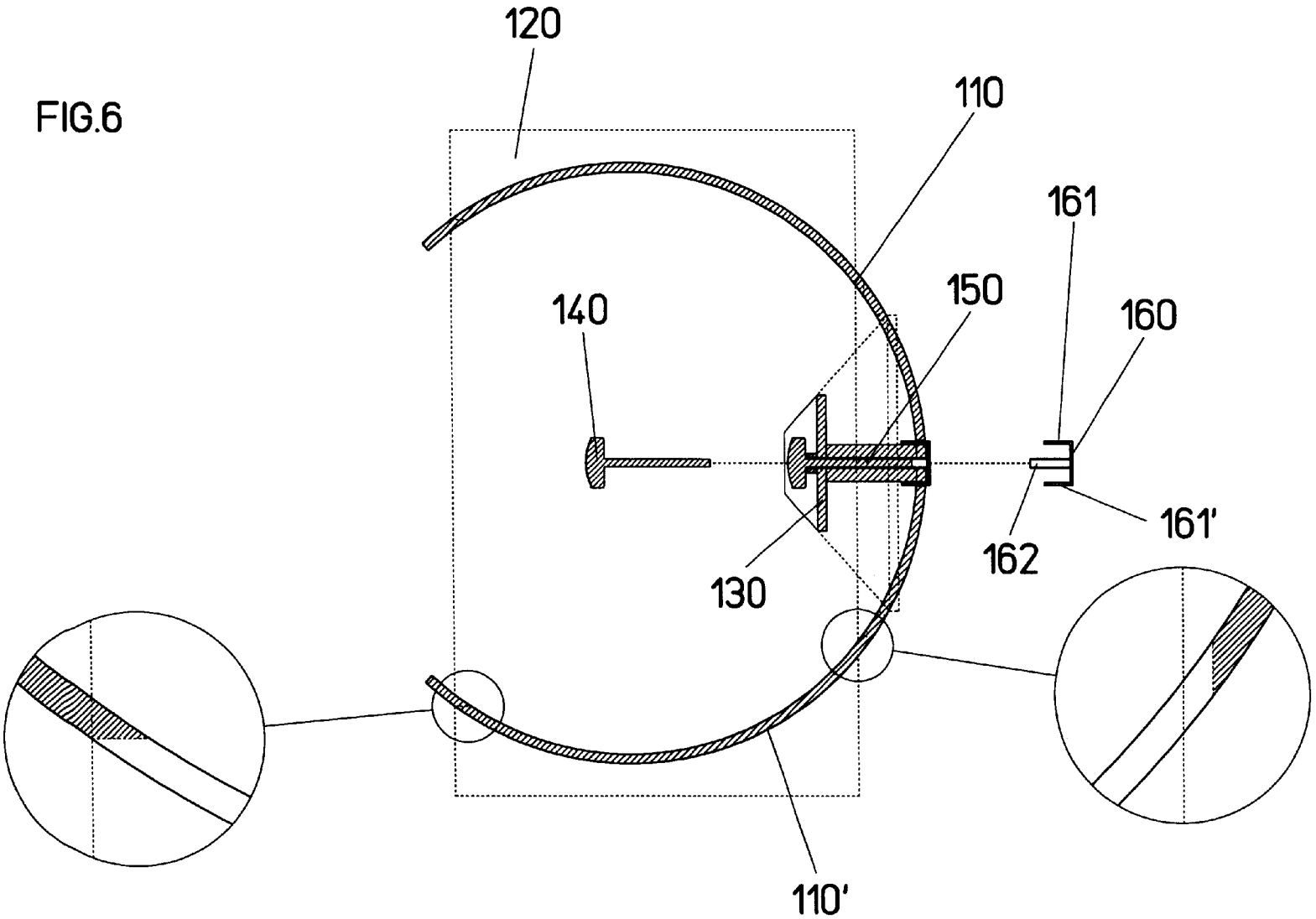
FIG. 6 shows a horizontal section of variation one.

FIG. 6 shows in detail the shape of the ends of the roughly horizontal slot 111' of upright 110'. The front end of slot 111' is perpendicular to the front side of seat 120, while the rear end is parallel to seat 120's rear edge. Similarly, the ends of slot 111 are perpendicular to the front edge of seat 120 with regard to the front end and parallel to the rear edge of seat 120 with regard to the rear end.

The seat shown can be assembled as follows. First, insert seat 120 into slots 111 or 111' of side uprights 110 or 110'. Next, insert back 130 into slot 122 on seat 120. The wedge is then positioned between the join of side upright 110 or 110' and back 130 with horizontal slot 152 lined up with notch 123 of seat 120. Seat 120 is then pushed into slot 111 or 111' on the second side upright, which is then pushed to meet the rear of the other side upright. Wedge 150, via inclined plane 153, pushes back 130 forward. Back 130, through its interlocking join with seat 120, also pushes it toward the front of the seat, so that notches 121, 121' drop into slots 111, 111' on the uprights. In this way, any lateral movement of seat 120 is prevented, and the front of uprights 110, 110' cannot move apart. Wings 161, 161' of rider 160 are inserted into slots 112, 112' on the side uprights, thus preventing the rear of the side uprights to move apart, while rider 160 is held by screw 140, which passes through hole 131 of back 130 and hole 151 of wedge 150, with the screw head positioned on the front face of back 130. In this way, screw 140 stops any vertical movement of back 130 and the whole assembly, once screw 140 and nut 162 are locked in place, can no longer come apart.

Figure 7:
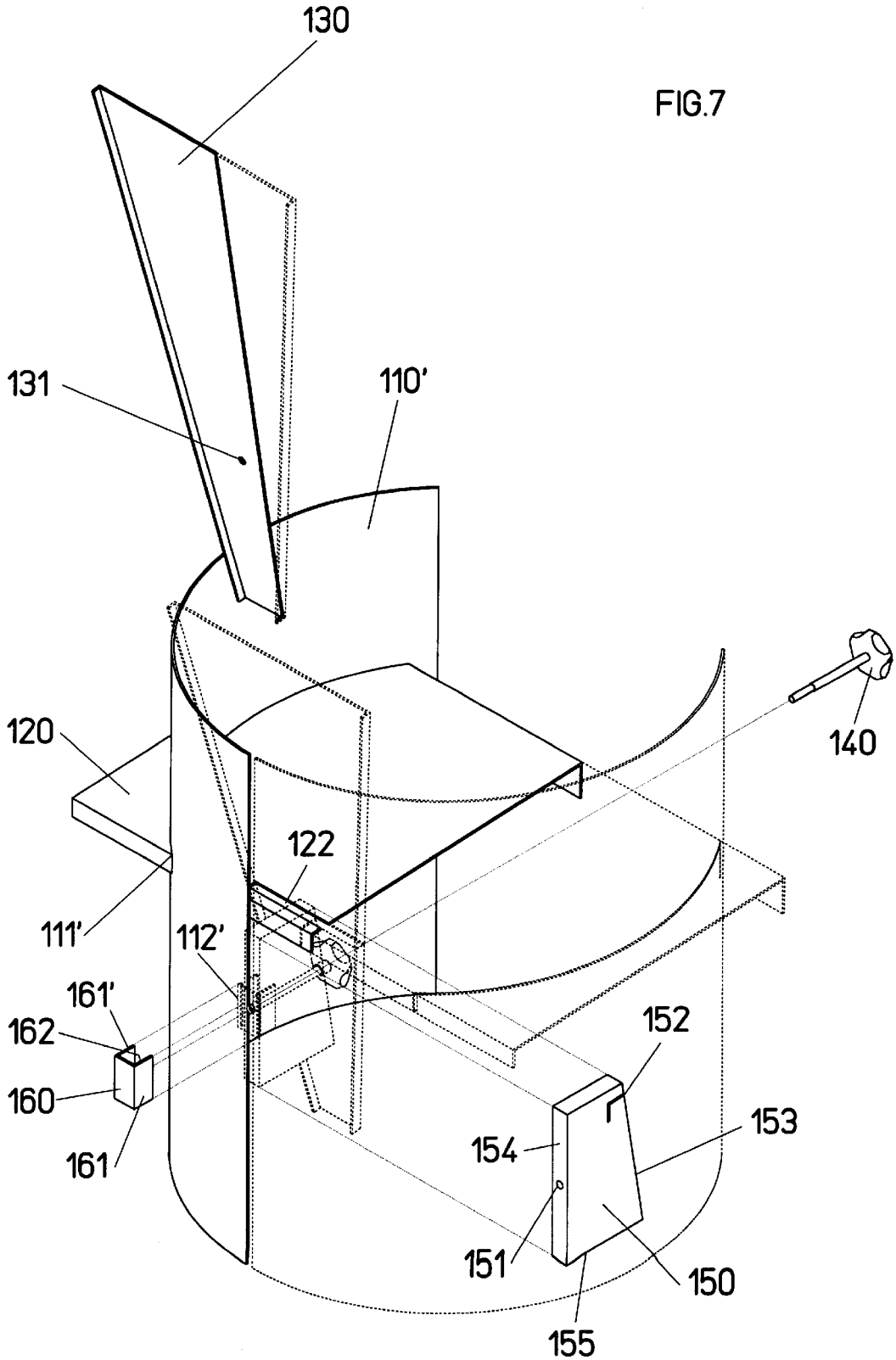
FIG. 7 shows a rear perspective view and a vertical section of variation two on the first configuration.

FIG. 7 shows a second variation on the first configuration. This variation is suitable when metal, such as aluminum, is used in the construction. Components common to the first configuration and this first variation are labeled using the same references. Specifically, in this variation, the edges of seat 120 and back 130 are bent to ensure sufficient rigidity. In addition, the edges of side uprights 110 110' can also be bent for the same reason. It is also possible to create a rib instead of bending the edges. Wedge 150 has a slot 152 into which seat 120 is placed and its rear bent edge.

Figure 8:
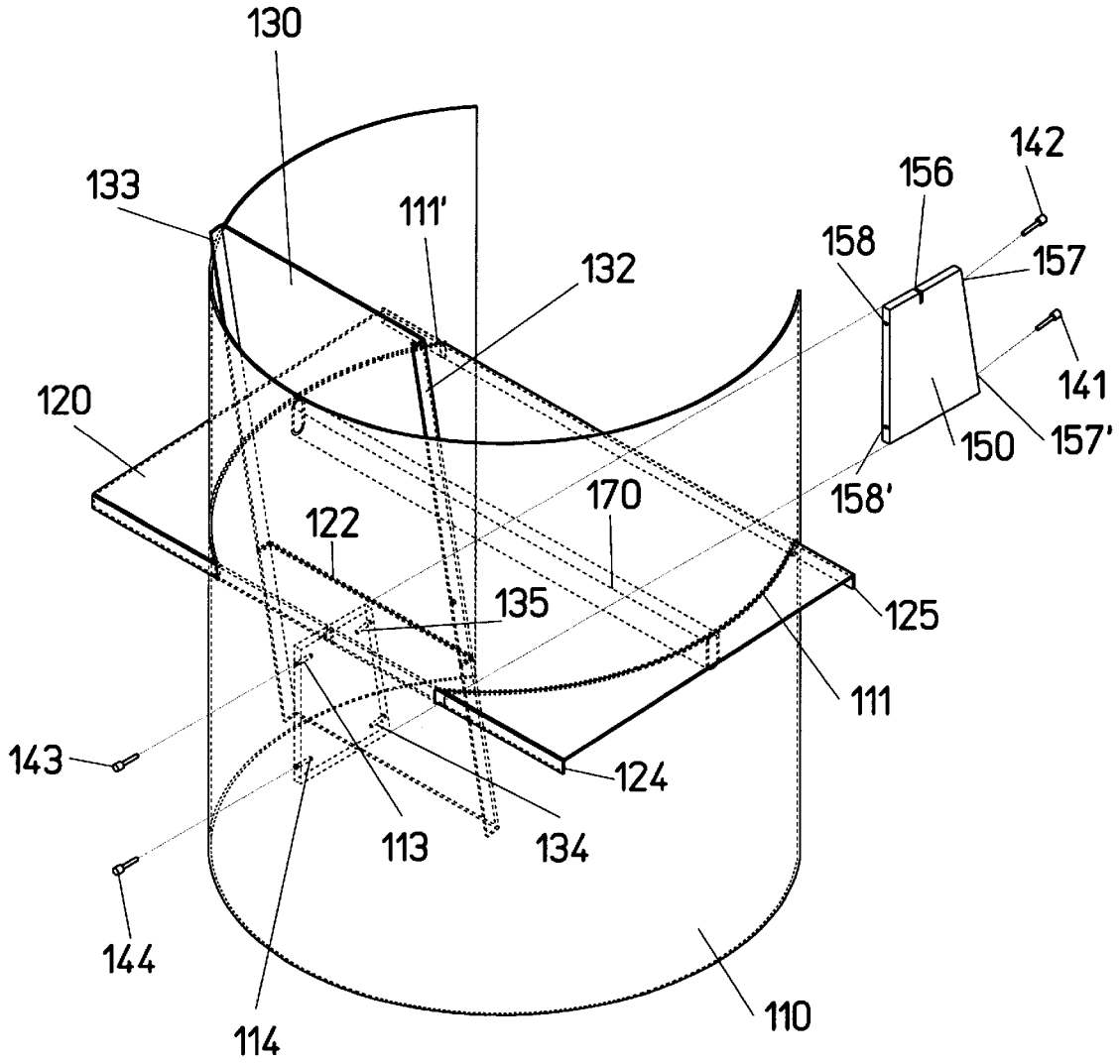
FIG. 8 shows a rear perspective of variation three on the first configuration.

FIG. 8 shows a second variation on the first configuration. Components common to the first configuration and this variation are labeled using the same references. Specifically, this variation comprises a single piece upright 110 made from metal—aluminum, for example—rolled to give it the shape of a truncated cylinder. To increase their rigidity, seat 120 and back 130 have bent edges 124, 125, respectively 132, 133. Rather than bending the edges, it is also possible to use ribs on these surfaces to achieve the same effect. The primary interlocking system consists of roughly horizontal slots 111, 111' in upright 110 into which seat 120 is inserted. The second interlocking system is slot 122 on seat 120, designed to be interlocked with back 130. The third interlocking system comprises a roughly vertical slot 156 in the upper part of the wedge and which is designed to interlock with bent edge 124 of seat 120. In the variation shown, the whole seat is held by four screws 141, 142, 143 & 144, two screws (141 & 142) passing through corresponding holes 134, 135 of back 130 into holes 157, 157' of the wedge piece, and two screws (143 & 144) passing through corresponding holes 113, 114 of upright 110 into holes 158 & 158' of the wedge. The figure also shows strengthening piece 170: a transverse bar fixed at both ends to bent upright 110 to prevent movement. In place of this bar, mechanical or welded fastening points may also be used between seat 120 and upright 110.

Mounting the seat in this variation is carried out in a similar way to the other variations. The seat is first interlocked with the upright, then the back is interlocked with the seat and the wedge is interlocked with the seat. Finally, the screws are placed in their respective holes and tightened.

In addition, this variation allows the use of a single screw to be passed through the back, wedge piece and upright and used in conjunction with a nut, instead of the four screws shown in FIG. 7.

Figure 9:
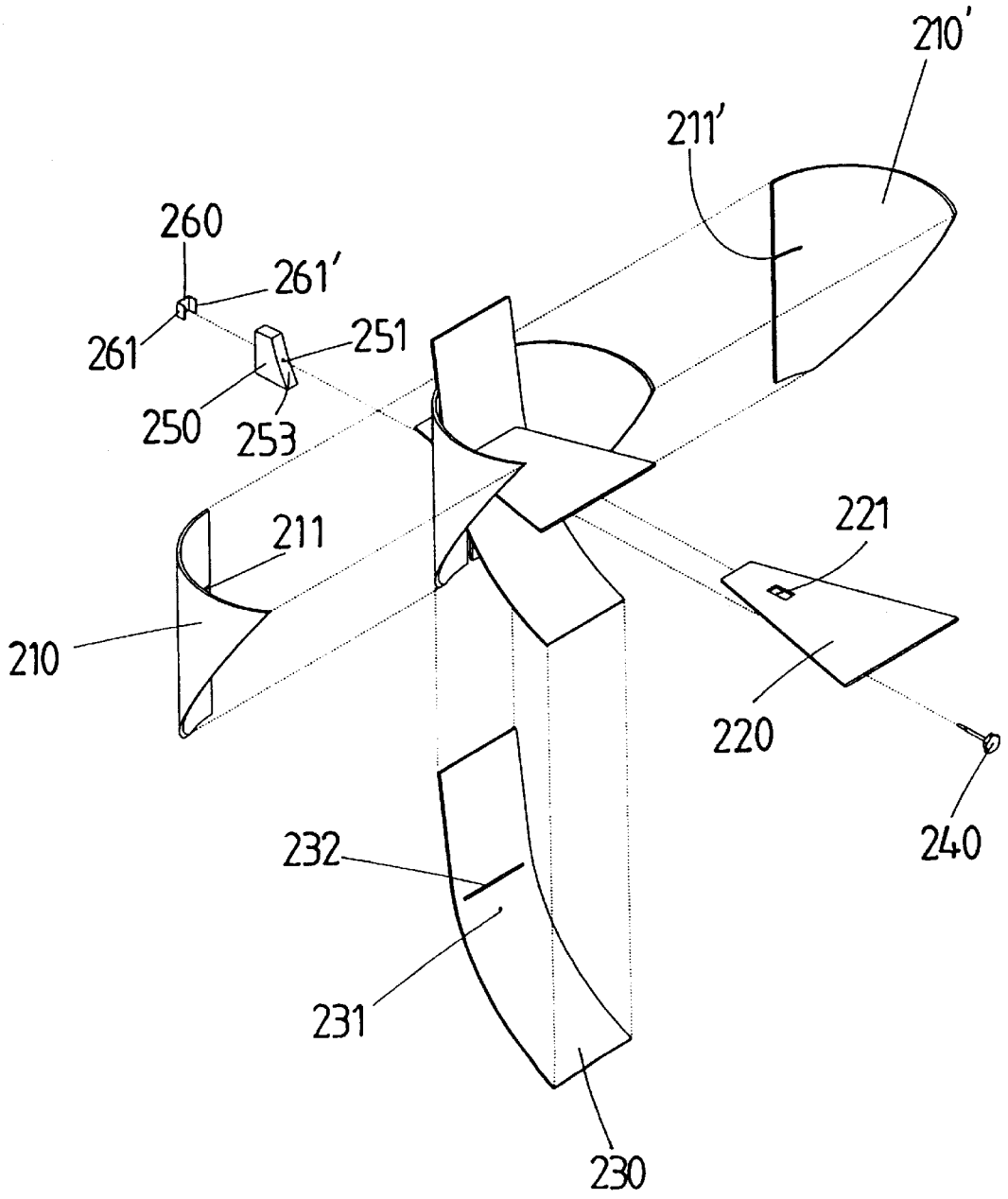
FIG. 9 shows a full perspective of configuration two of the seat.
Figure 10:
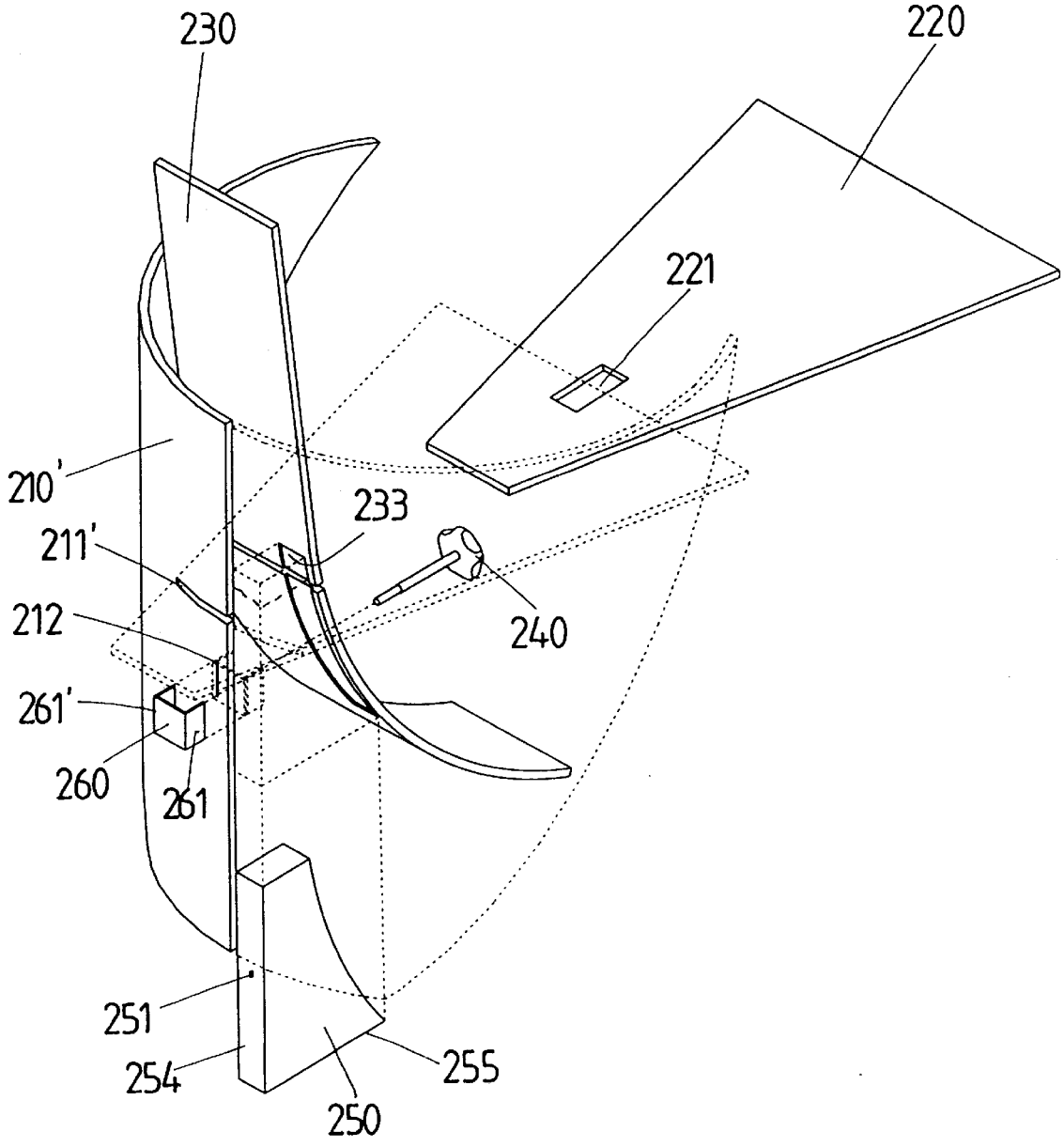
FIG. 10 shows a rear perspective with a partial vertical section of configuration two.
Figure 11:
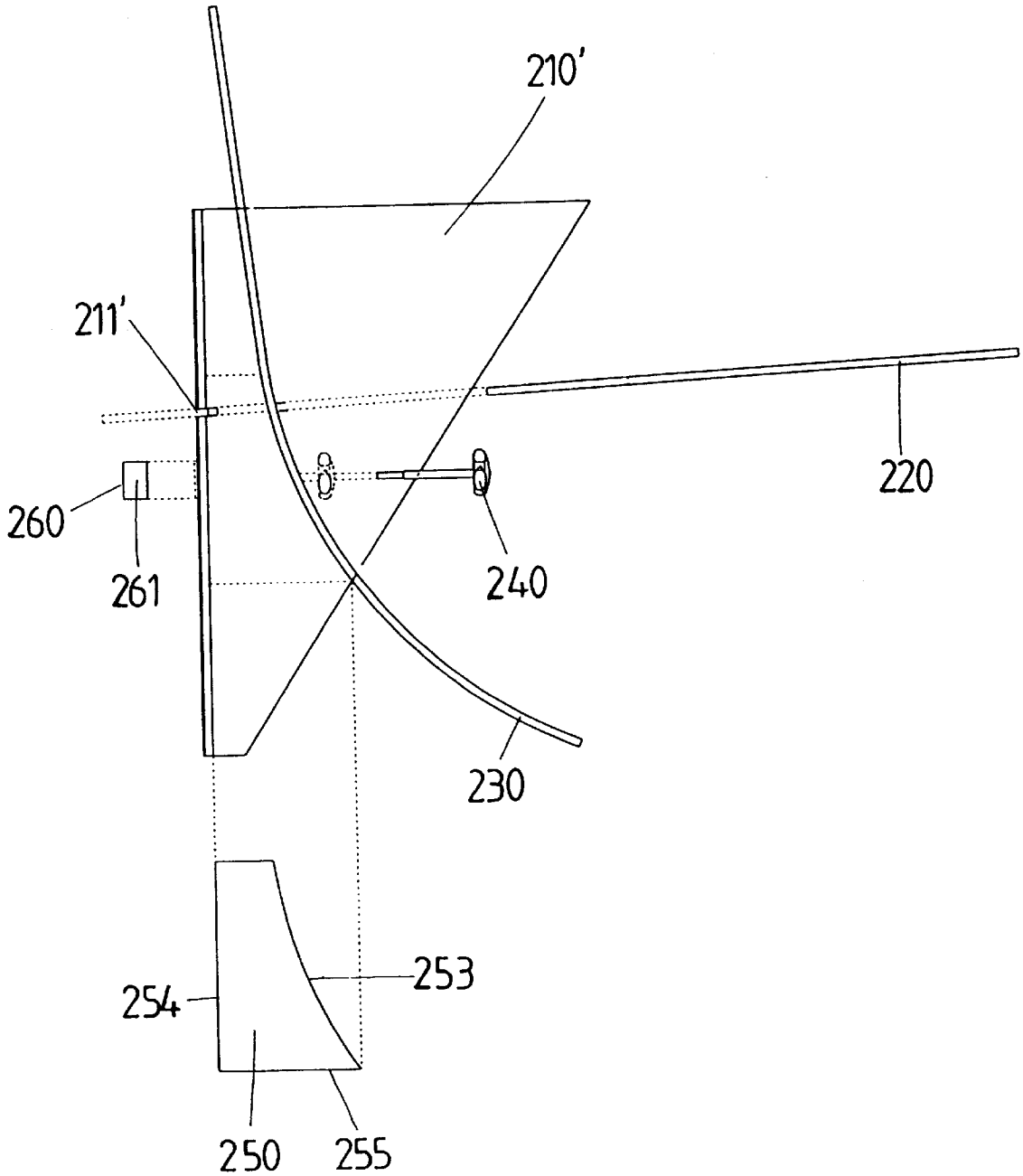
FIG. 11 shows a vertical section of configuration two.

FIGS. 9 through 11 show the seat's second configuration.

In this configuration, the seat support on the floor by the lower part of back 230 and the lower part of uprights 210, 210' close to the rear join. In this configuration, the primary interlocking system comprises slots 211, 211' in uprights 210, 210', the second interlocking system comprises a horizontal slot 232 in back 230 and it is seat 220 that fits into the back. A third interlocking system is a rectangular cut-out 221 in seat 220 into which the upper part of a wedge 250 is pushed. Inclined plane 253 of wedge 250 works in conjunction with countersink 233 situated in the rear surface of the back. In this configuration, rider 260, which is firmly attached to nut 262, is also used to lock the joins on the side uprights by means of its wings 261, 261'. Nut 262 is connected to screw 240 which also passes through back 230 and wedge 250 via holes 231, 251 respectively.

Figure 12:
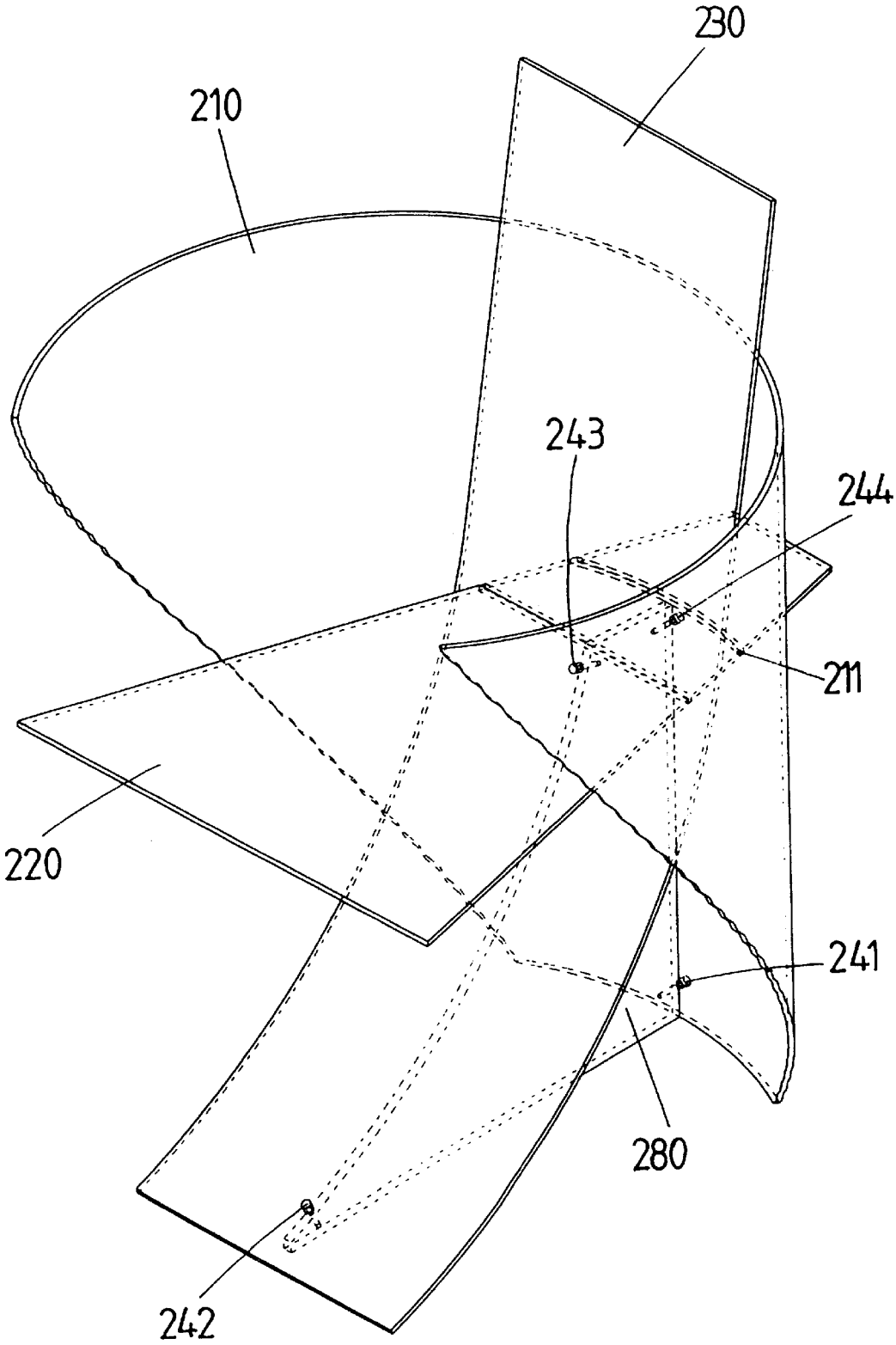
FIG. 12 shows a front perspective of a variation on configuration two.
Figure 13:
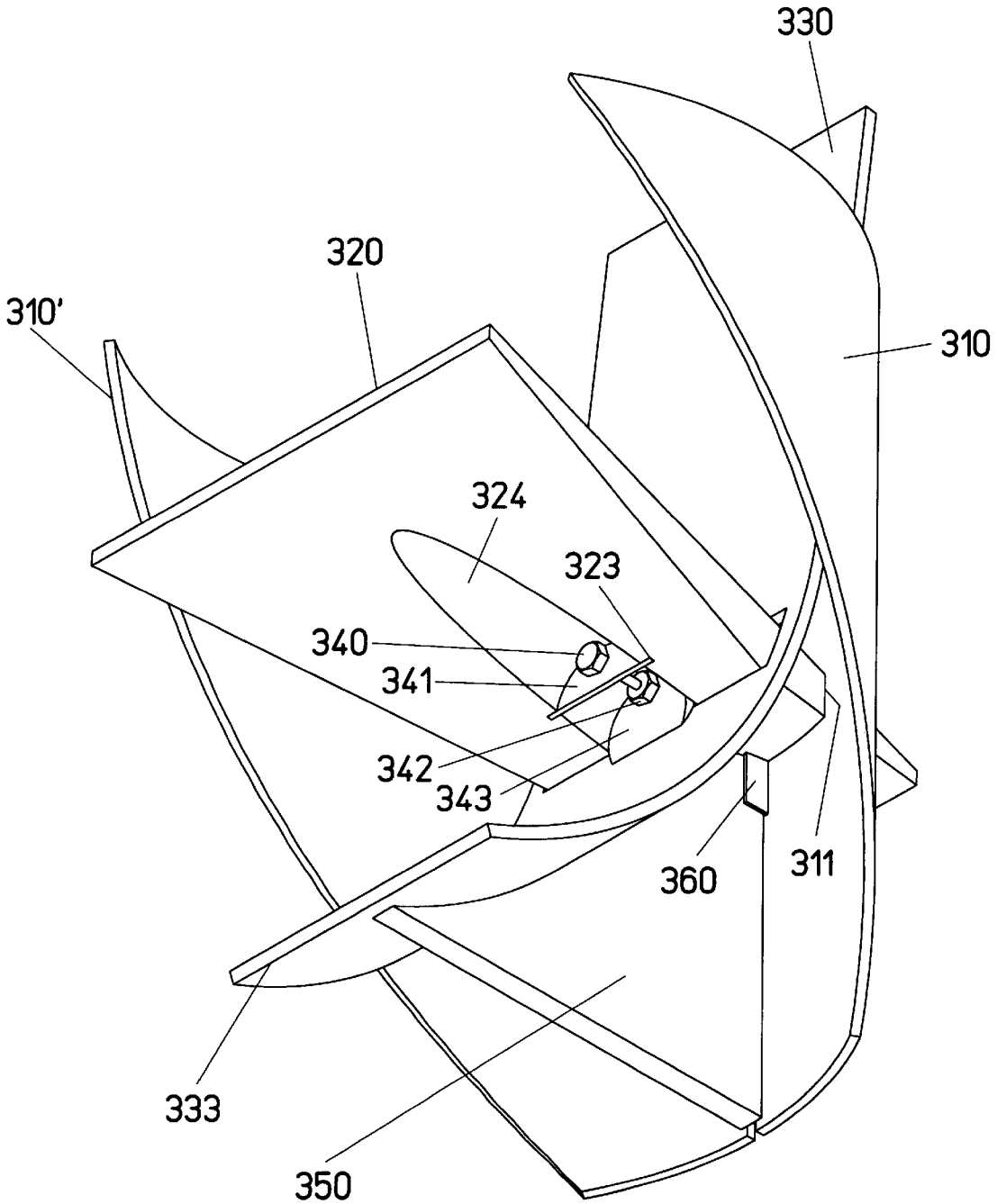
FIG. 13 shows the whole arrangement, from beneath and in perspective, of configuration three of the seat.
Figure 14:
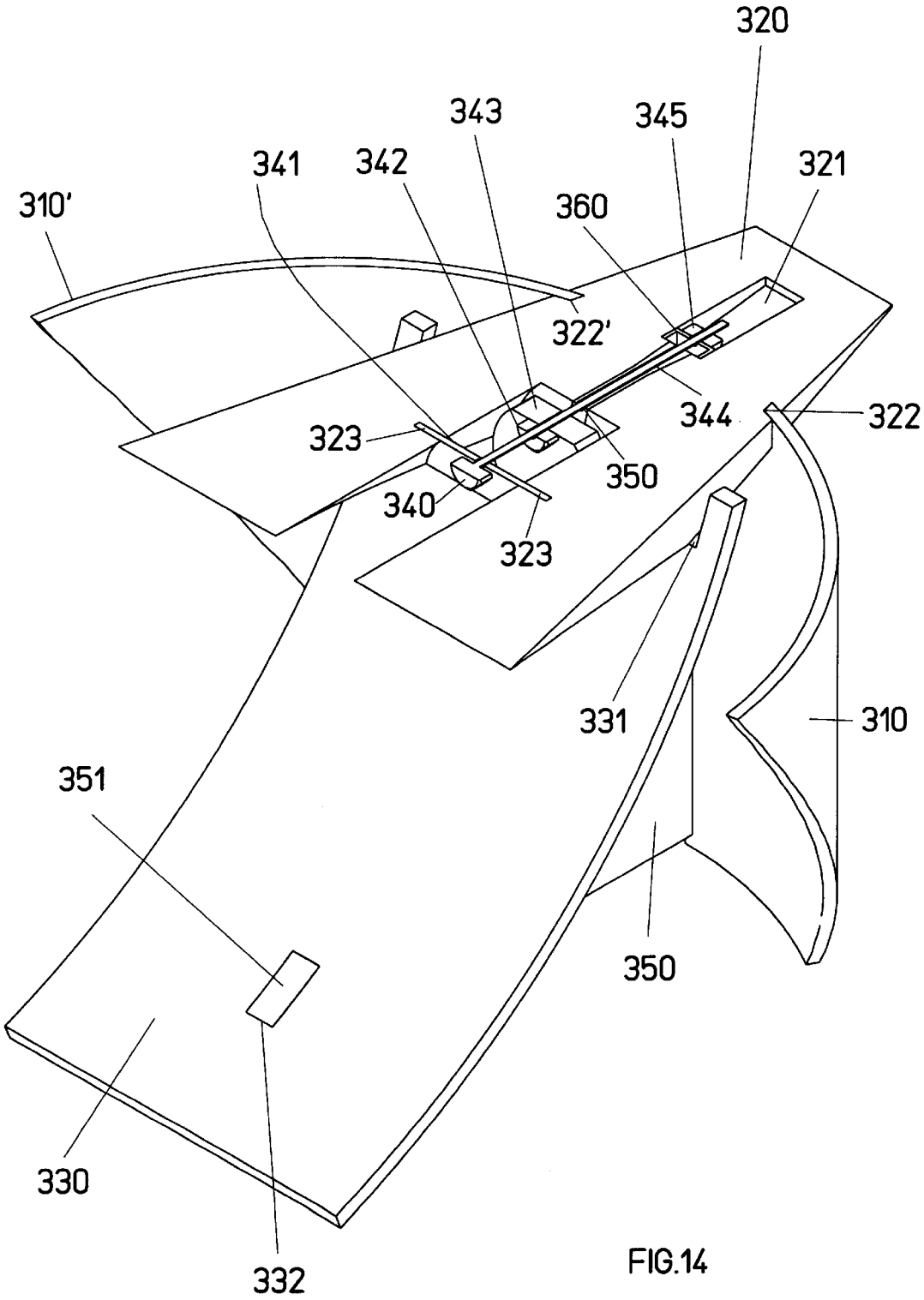
FIG. 14 shows a perspective and a horizontal section of configuration three.
Figure 15:
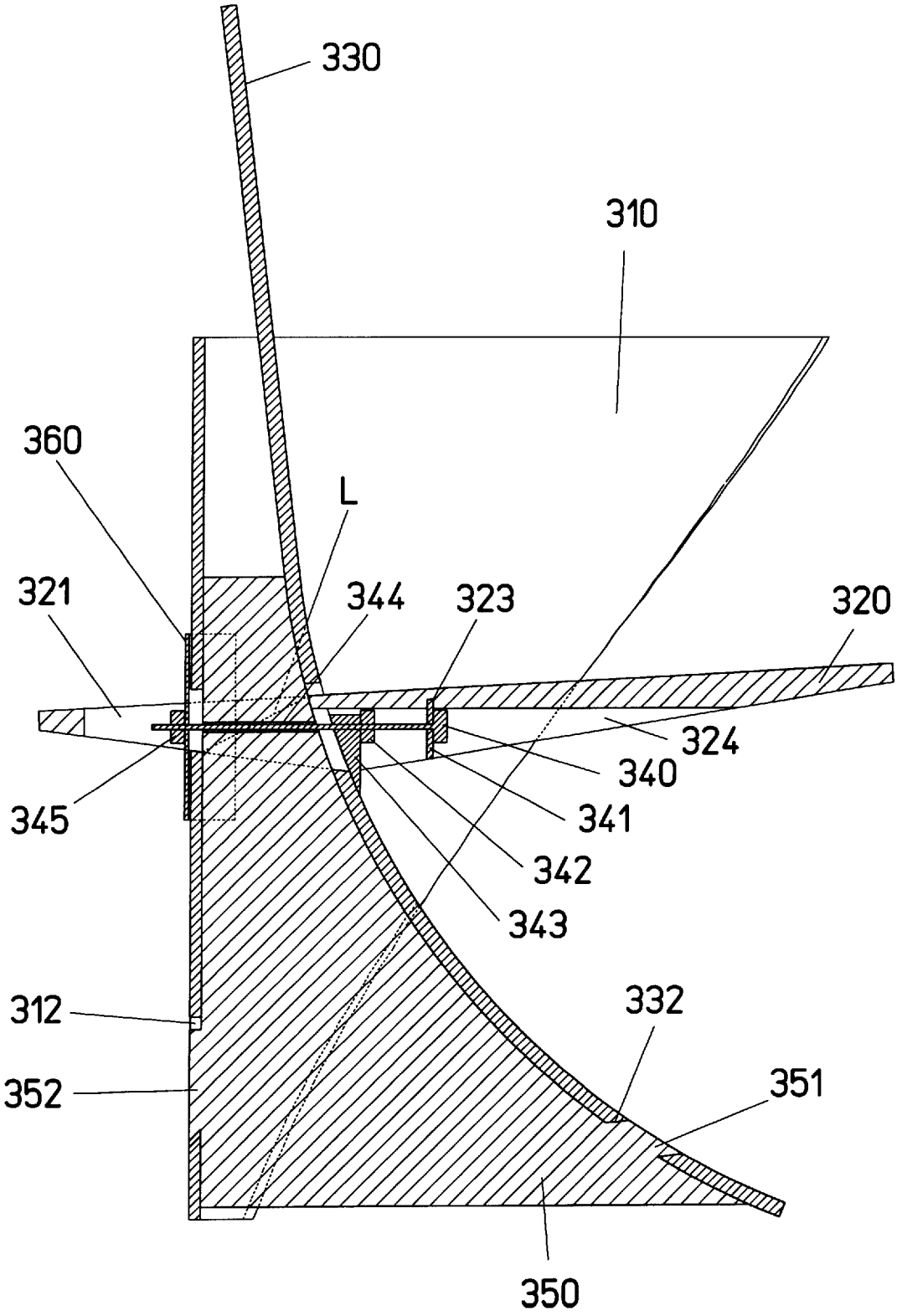
FIG. 15 shows a vertical section of configuration three.

A variation on this second configuration is described with reference to FIG. 12. Components common to the second configuration and this variation are labeled using the same references. This variation comprises upright 210, seat 220, back 230 and wedge 280. Upright 210 comprises a single piece, wedge 280 goes down to the floor and the single screw from the second variation is replaced here by four screws 241, 242, 243 and 244, two of which (242 & 243) fix the wedge piece to the inclined face of the wedge, while the two others (241 & 244) fix the wedge to the single upright. Specifically in this way, when someone sits on the seat, the ending stress acting on the lower part of the back 230 is taken up by four screws. This variation uses an interlocking system which is similar to the second configuration a primary interlocking system comprising slot 211 in upright 210 and a second interlocking system comprising slot 232 in back 230.

A third configuration for our invention will now be described with reference to FIGS. 13 through 20. In this configuration, the seat essentially comprises symmetrical side uprights 310, 310', seat 320, back 330, screw 340, a spine wedge system 350, a rider 360, support piece 341, block 343 and two screws 342 & 345.

Uprights 310, 310' are part cylindrical in shape and are joined edge to edge at the rear of the seat. Each one comprises the primary interlocking system a roughly horizontal rectangular cut-out 311, 311' (see FIG. 20) into which seat 320 is inserted roughly perpendicular to the rear join of the side uprights 310, 310'. The lower edge of the uprights constitutes one of the means of support for the seat on the floor.

By way of a second interlocking system, back 330 has a primary rectangular horizontal cut-out 331, through which seat 320 is inserted and which is larger than the section of seat 320. The lower edge 333 of the back, which protrudes forward, is in contact with the floor and makes up the other means of support for the seat.

A third interlocking system is provided by a rectangular longitudinal cut-out 321 in the rear of seat 320. This cut-out comprises a wide part and a narrow part into which the upper part of spine 350 is inserted. In addition, symmetrically on each side of seat 320 there is a vertical notch 322, 322', designed to interlock with the vertical edge of rectangular cut-outs 311, 311' in uprights 310, 310'. Finally, seat 320 has a notch 323 on its under side perpendicular to the longitudinal axis into which locking part 341 is inserted and a countersink 324 on the longitudinal axis.

Spine 350 reaches almost down to the floor and includes on the lower part of its front edge, which moulds against the rear surface of back 330, a horizontal half-dovetail 351 which slots into a second cut-out 332 on the back so that the back is firmly attached to spine 350 in such a way that the latter does not move when someone sits on the seat. Spine 350 also has another half-dovetail 352 on the lower part of its vertical rear edge which slots into cut-out 312, 312' in joined uprights 310, 310', thus attaching spine 350 firmly to uprights 310, 310'. In this way, when someone sits on the seat, the bending stress acting on the lower part of back 330—as the latter is supported by the floor—is taken up by dovetail 351 on spine 350 and transmitted to uprights 310, 310' by dovetail 352 on the rear face of spine 350.

Figure 16:
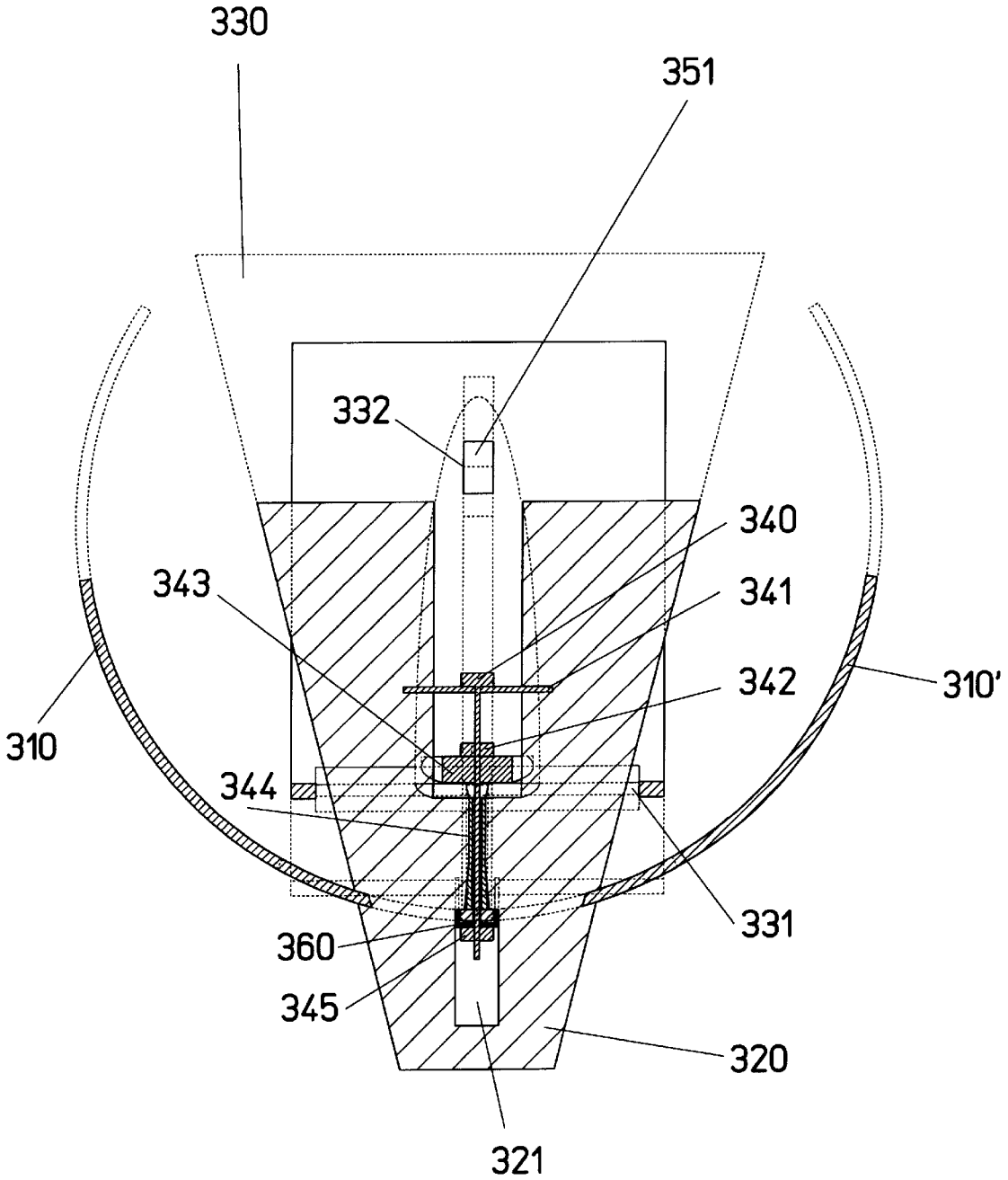
FIG. 16 shows a horizontal section from above of configuration three.
Figure 17:
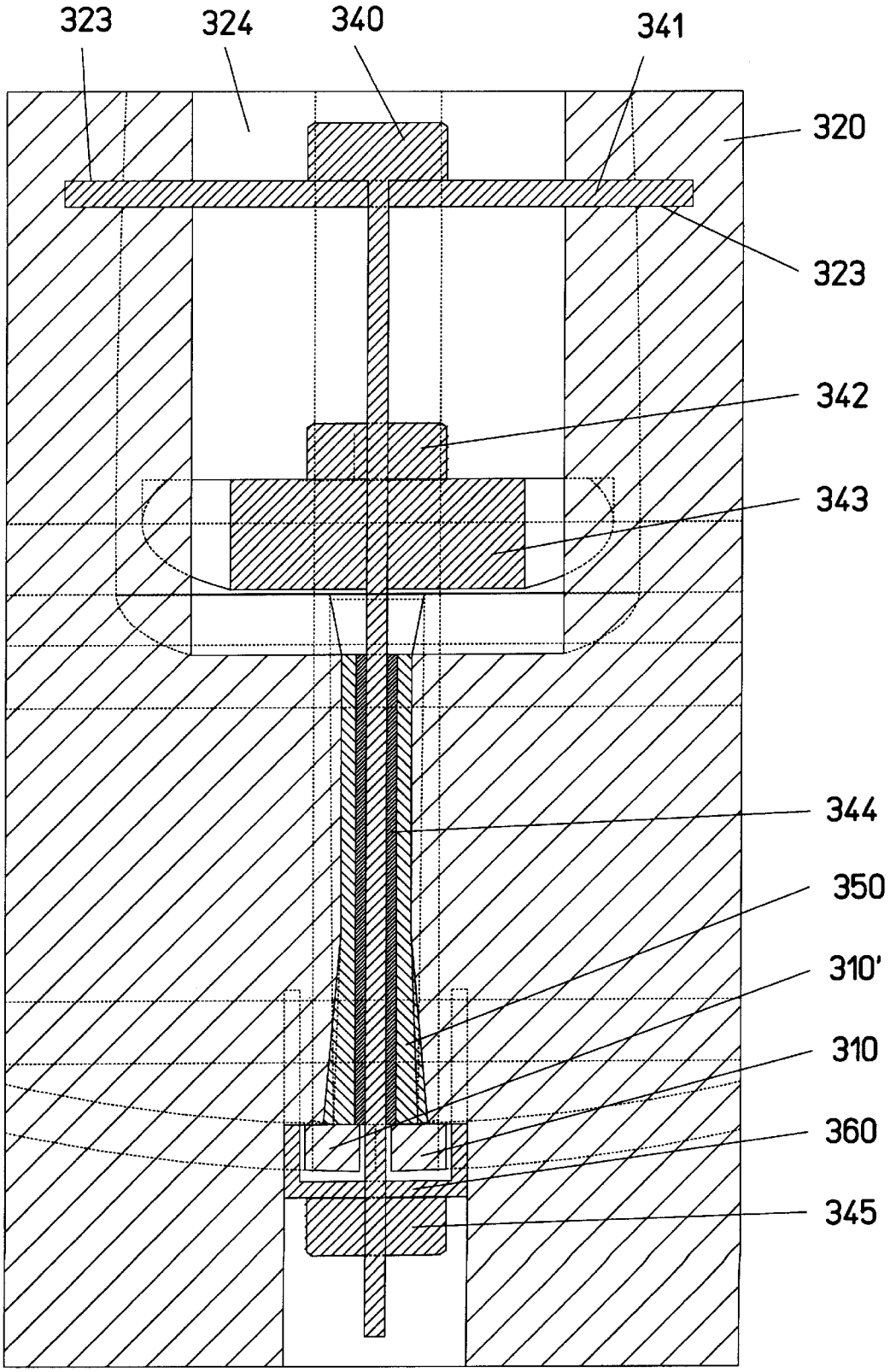
FIG. 17 shows a horizontal section of the fastenings on configuration three.
Figure 18:
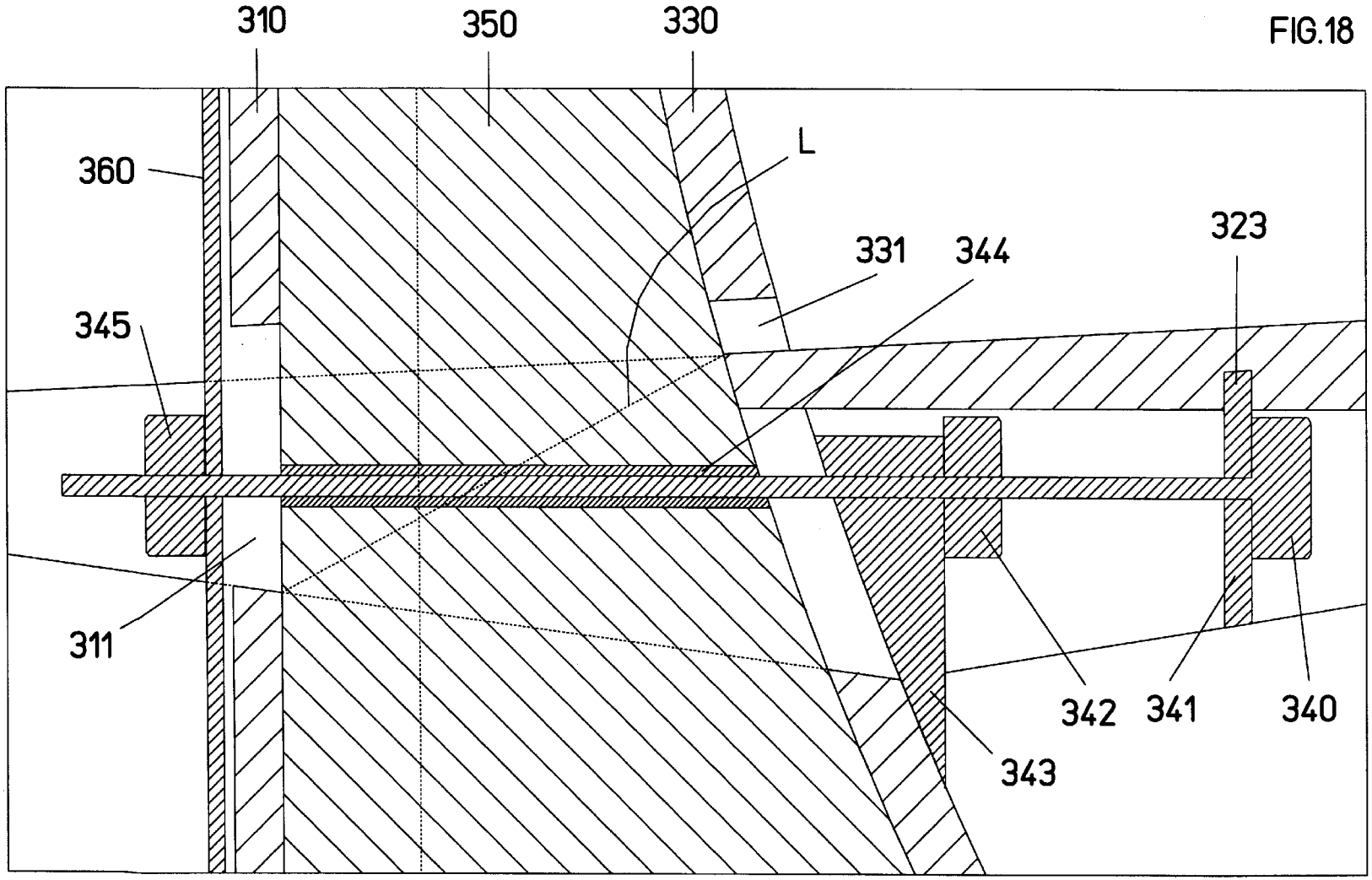
FIG. 18 shows a vertical section of the fastenings on configuration three.
Figure 19:
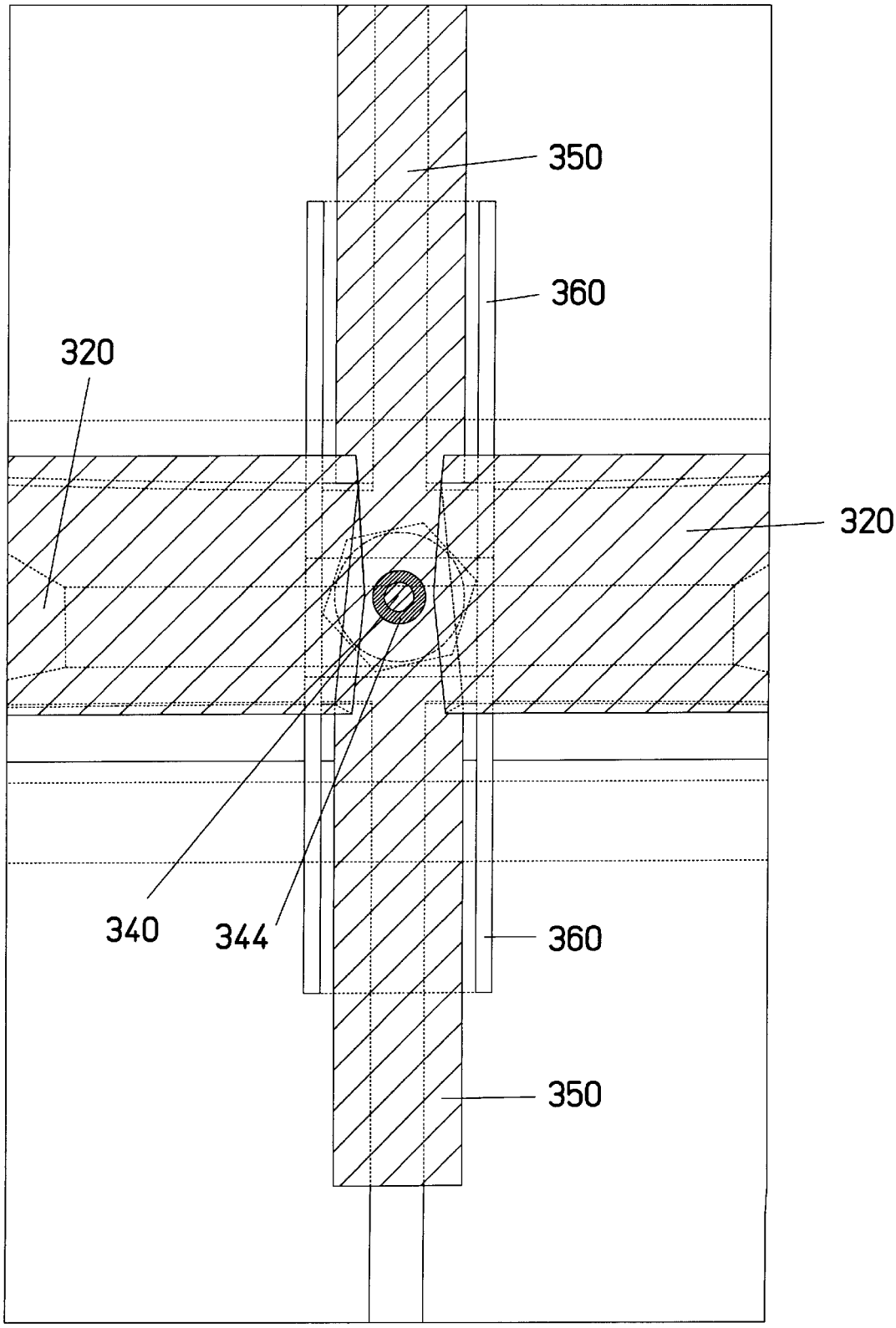
FIG. 19 shows a vertical section, perpendicular to the seat's axis, of the fastenings on configuration three.
Figure 20A:
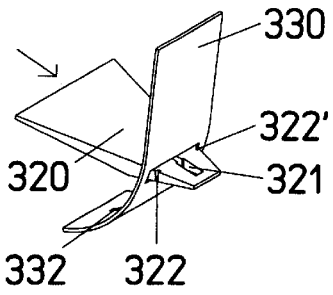
Figure 20B:
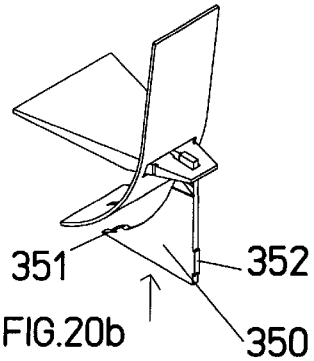
Figure 20C:
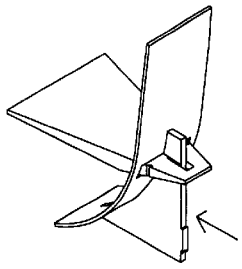
Figure 20D:
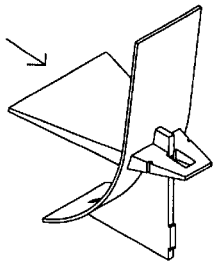
Figure 20E:
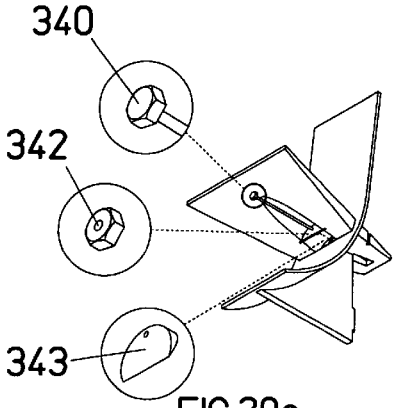
Figure 20F:
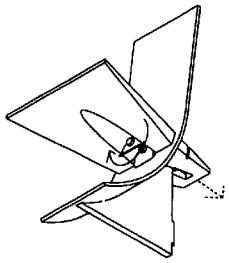
Figure 20G:
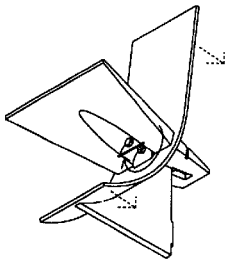
Figure 20H:
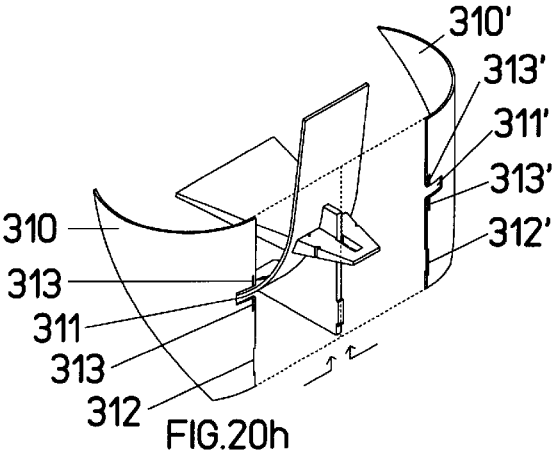
Figure 20I:
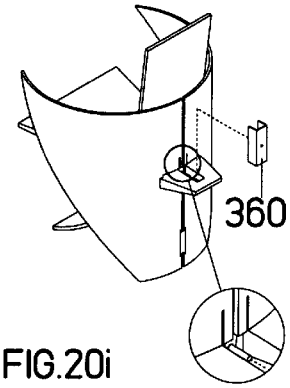
Figure 20J:
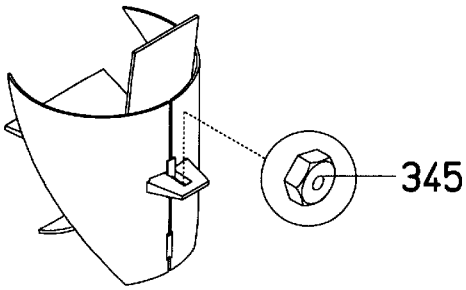

Details of the wedge system are shown in FIGS. 17 through 19. This system is cut into the faces of the upper part of spine 350 and comprises two inclined planes, which produce a double wedge effect, thereby preventing the seat 320 from tipping forward. When someone sits down, seat 320—which protrudes from the overall assembly—will tend to rotate forward around the join at spine 350. To prevent any rotation, therefore, the contact surface toward the top of the rear of the spine and the contact surface toward the bottom of the front of the spine flare in such a way as to create this double wedge effect when there is a load on the seat, thereby preventing any rotation. This flaring can be seen in detail in figures 14 through 16. The contact surfaces on seat 320 are also cut to match the surfaces of the spine, as shown in FIG. 16. The intersection of these two inclined planes gives the inclined line L, shown in FIG. 18.

The locking devices used in this configuration are more particularly described in detail with reference to FIGS. 17 & 18. These devices comprise basically a screw 340, a support piece 341, two nuts 342, 345, a block 343, a female-thread dowel bush 344 and a rider 360. Specifically, the female-thread dowel bush is imbedded within spine 350, in the middle of the area containing the double wedge and is positioned roughly horizontally. The seat is locked in place in three stages using these components. Stage 1 consists of locking seat 320 to spine 350 using screw 340, support piece 341 inserted in slot 323 of seat 320 and the female-thread dowel bush 344 imbedded in spine 350. With the head of the screw in contact with support piece 341 linked to seat 320, tightening of screw 340 in female-thread dowel bush 344 linked to spine 350 will now hold seat 320 firmly in position with spine 350. The second stage then consists of screwing back 330 to spine 350 using the first nut 342 and block 343—already mounted on to screw 340—in the direction of female thread dowel bush 344. Since the rectangular cut-out 331 in back 330 is larger than the section of seat 320, back 330 can slide freely over seat 320. The third and final stage is to fix uprights 310, 310' by interlocking them with vertical slots 322, 322' on seat 320, fixing them together using rider 360, whose wings 361, 362 fit into slots 313, 313' on uprights 310, 310'. Rider 360 is then held in place by the second nut 345 on screw 340.

The seat can be assembled as shown in FIG. 20. Seat 320 is slotted through cut-out 331 in back 330, spine 350 is then inserted into seat 320 behind back 330. Next, screw 340, the first nut 342, support piece 341 and block 343 are positioned and tightened. Finally, uprights 310, 310' are interlocked with seat 320 and spine 350, the wings of rider 360 are inserted into uprights 310, 310' and rider 360 is held on screw 340 by nut 345.

A fourth configuration for this invention will now be described with reference to FIGS. 21 through 24. Specifically, this configuration uses two symmetrical side uprights 410, 410', seat 420, back 430, a wedge system 450, 470, rider 460, screw 440 and nut 441. In this configuration, the side edges on back 430 and on seat 420 are bent approximately 900. It is also possible to introduce a rib instead of the fold to achieve comparable strengthening.

Uprights 410, 410' each contain a roughly horizontal slot 411, 411' running out from their vertical rear edges and two roughly vertical slots 412, 412', 413, 413' linked to the horizontal slots, with the second vertical slots 413, 413' extending horizontal slots 411, 411' and with the first vertical slots 412, 412' being positioned between the rear edges of the uprights and the second vertical slots 413, 413'. By way of a primary interlocking system, seat 420 and its bent edges 421, 422 are inserted into horizontal slots 411, 411' and vertical slots 413, 413', while wings 461, 462 of rider 460 are inserted into vertical slots 412, 412'. The lower edge of the rear part of uprights 410, 410' is in contact with the floor, constituting a means of support for the seat.

Back 430 is rectangular in shape and is curved forward its vertical sides 431, 432 are bent approximately 90° in relation to the surface and the lower horizontal edge rests on the floor. Back 430 contains a rectangular cut-out 433 approximately half way down, through which passes seat 420 and which constitutes the second interlocking system.

The wedge system 450, 470 has two riders 450, 470 whose wings 451, 452, 471, 472 are flared.

On the back of the first rider 450 is an approximately horizontal slot 456, two vertical rectangular cut-outs 454, 455 linked by slot 456 and a hole 453 roughly in the center of the back. Seat 420 is inserted through slot 456 before being inserted into slots 411, 411' on the uprights and cut-outs 454, 455 are wide enough to accept the bent edges 421, 422 of seat 420 and the wings of rider 460. The rear of rider 450 can be curved so as to fit flush with the inner face of joined uprights 410, 410'.

In the center of the back of the second rider 470 is a hole 473. The third interlocking system is then provided by fixing seat 420 to riders 450 & 470 and back 430, as shown in FIG. 22.

The third rider 460, for the join on side uprights 410, 410', can have a curved central part corresponding to the curve of the external face of the joined side uprights and drilled with a hole 463 to allow screw 440 to pass through, and two wings 461, 462 which fit into corresponding slots 412, 412'on uprights 410, 410'.

The whole assembly is held together by interlocking the various components and by tightening nut 441 on to screw 440. FIGS. 21 & 24 show particularly how this is achieved. Seat 420 is inserted through cut-out 433 in back 430 and then into slot 456 on the first rider 450 and into horizontal slots 411, 411' on uprights 410, 410'. The sides of cut-out 433 are now trapped between the exterior of bent edges 421, 422 of seat 420 and wings 451, 452 of rider 450. Because seat 420 is trapezoidal in shape, longitudinal movement is restricted. Rider 460 holds uprights 410, 410' together and maintains the lateral position of component 450. The flared shape of seat 420 and the second rider 470, whose wings push against the inside faces of bent sides 421, 422 of seat 420, creates a wedge effect when nut 441 is tightened on screw 440. This wedge effect pulls seat 420 rearward by means of the second rider 470 and also pulls back 430 flush with the inside of component 450.

This configuration can be assembled as follows seat 420 is fitted to back 430 and the first rider 450. Uprights 410, 410' are then interlocked with the rear of seat 420. The third rider 460 and the second rider 470 are then positioned and the whole assembly is then held together with screw 440 and nut 441.

In this configuration, screw 440 can be backed up by two lateral screws through wings 451, 452 of rider 450, bent edges 431, 432 of back 430, bent edges 421, 422 of seat 420 and wings 471, 472 of rider 470. In addition, the central screw 440 can also be replaced by two screws with the same function.

The different component parts of the seat, such as the uprights, seat, back and wedge piece may be made out of wood, metal, plastic, fiber glass, carbon etc. A particularly good material is solid laminate.

The invention may be configured in ways not described herein. Indeed, the means by which the various component parts of the seat interlock allows for different configurations, e.g. by attaching rails to the side uprights and the seat.

Similarly, the screws and nuts used can be replaced by other suitable fasteners. The join on the uprights can also be provided by the rear face of the wedge itself pushing against the rear join of the side uprights, rather than relying on the friction of the nut or on a rider. Similarly, the rider can be replaced by equivalent fasteners, such as, for example, one or more screw- or rivet-plates.

What is claimed is:

1. A chair made from interlocking components comprising:

a) a plurality of side uprights;

b) a seat having a front end, and a back end;

c) a back having a top end and a bottom end;

d) a first interlocking system formed by an intersection between said seat and at least one substantially horizontal slot in said plurality of said side uprights;

e) a second interlocking system formed by an intersection between said back end of said seat, and said back securing said seat substantially perpendicular to said back;

f) a means for connecting said plurality of side uprights, said seat and said back together wherein said means comprises a wedge system disposed between said back and said plurality of side uprights; and g) a fastening means for securing said wedge system to said back and said plurality of side uprights wherein said seat, said plurality of side uprights and said back are fixed together, so that said wedge system attaches to said side uprights, wherein said back fits over said wedge and is supported by said fastening means, with said seat and said back fitting together in a substantially perpendicular manner and with said wedge system being aligned in a substantially perpendicular manner to said back to form a chair assembly.

2. The chair according to claim 1, wherein said fastening means comprise at least four screws, wherein two of said screws lock said back to said wedge system, while the other two screws lock said wedge system to said side uprights.

3. The chair according to claim 2, wherein said seat has a series of longitudinal edges that are bent at both a back end and a front end and wherein said wedge system has a vertical slot formed in an upper region such that the chair further comprises a third interlocking system formed by an intersection between said vertical slot in said wedge system that receives said bent longitudinal edge disposed along said back end of said seat.

4. The chair according to claim 1, wherein said seat further comprises a notch on a rear side of said seat and a horizontal groove on an inclined face of said wedge system forming a third interlocking system whereby said seat interlocks with said wedge system.

5. The chair according to claim 4, wherein said fastening means comprises a screw that passes through said back and said wedge system, and a nut for screwing on to said screw so that said nut on to said screw holds said chair together.

6. The chair according to claim 5, wherein each of said plurality of side uprights are formed as a semicircular one-piece member.

7. The chair according to claim 6, wherein said seat has two notches on a front edge which fits into the front ends of said slots in said side uprights to prevent lateral movement between said seat and said side uprights in a front part of said seat.

8. The chair according to claim 5, wherein said wedge system comprises a spine having edges and wherein one of said edges of said spine contacts said back and another of said edges contacts said plurality of said side uprights and wherein an upper part of said spine fits into a cut-out of said seat.

9. The chair according to claim 8, wherein said spine is cut in two parts forming at least two wedges in said upper part of said spine wherein said spine interlocks with said seat and includes two flared surfaces, one on each side of said spine, with one surface flared diagonally up to the rear of said spine, and the other surface flared diagonally down to a front of said spine to prevent any downward rotation of said seat.

10. The chair according to claim 9, wherein said spine includes a half dovetail on a lower part, on a side supporting said back, which is designed to interlock with the corresponding cut-out on the back and a second half dovetail on the side pressing against the uprights and slotted into a corresponding cut-out in uprights so that the lower part of the back is held fast against uprights by means of said spine.

11. The chair according to claim 8, wherein on each side of said seat there are at least two notches to interlock with said edges of said cut-outs in said plurality of side uprights.

12. The chair as in claim 8, wherein said seat further comprises a slot, and said screw further comprises a head and wherein the chair further comprises a fourth interlocking system comprising:

a support piece having a hole wherein said support piece fits into said slot in said seat and said screw fits into said hole in said support piece;

a block being disposed adjacent to said spine, said block having a hole for receiving said screw;

a second nut fitting around said screw and being disposed adjacent to said block; and a female dowel bush imbedded longitudinally in said spine wherein said female dowel bush allows said seat to be held against said spine by means of said support piece being inserted into said seat so that when said second nut is tightened on said screw between said head of the screw and said dowel bush, said block holds said back tight against said spine.

13. The chair according to claim 5, wherein said seat has side edges wherein said side edges and said back are bent roughly 90°.

14. The chair according to claim 13, wherein an outer end of said side uprights protrudes roughly vertically and is designed to accept said bent edges of the seat, said second interlocking system is the hole in said back, said hole having said shape of a horizontal rectangular cut-out, and said third interlocking system is a roughly horizontal slot in said back of a first rider and two vertical rectangular cut-outs with said slot and said cut-outs being designed to accept said seat and its bent edges.

15. The chair according to claim 14, wherein said wedge system comprises two riders serving as support brackets, said first rider being positioned between said back and said uprights of said seat and a second rider being positioned beneath said seat, wherein both these riders each have a hole through which passes said screw wherein by tightening said nut on said screw, said riders and said back ensure that said seat, said back and said uprights are correctly interlocked.

16. The chair as in claim 1, wherein said seat also has a transverse strengthening system fixed to said side uprights beneath said seat.

17. The chair according to claim 1, wherein said back is shaped in a convex manner.

18. The chair according to claim 1, further comprising joint systems formed as U-shaped brackets holding a rear portion of said side uprights together.

19. The chair according to claim 18, wherein said joint systems comprise a rider having a set of wings and a set of corresponding vertical slots situated in said side uprights with said vertical slots designed to accept said wings of the rider.

20. The chair according to claim 19, further comprising two lateral fasteners on each side of said seat which pass through the wings of the rider, the bent edges of the back, the bent edges of the seat and the wings of the rider.

21. The chair according to claim 1, wherein each of said side uprights are formed as a single piece.

* * * * *